US005116430A

United States Patent [19]

Hirai et al.

[11] Patent Number: 5,116,430

[45] Date of Patent: May 26, 1992

[54] PROCESS FOR SURFACE TREATMENT TITANIUM-CONTAINING METALLIC MATERIAL

[75] Inventors: Eiji Hirai; Kazuyoshi Kurosawa; Yoshio Matsumura, all of Tokyo, Japan

[73] Assignee: Nihon Parkerizing Co., Ltd., Tokyo, Japan

[21] Appl. No.: 653,087

[22] Filed: Feb. 8, 1991

[30] Foreign Application Priority Data

| | | | |
|---|---|---|---|
| Feb. 9, 1990 | [JP] | Japan | 2-30494 |
| May 21, 1990 | [JP] | Japan | 2-129268 |
| Sep. 11, 1990 | [JP] | Japan | 2-238998 |

[51] Int. Cl.[5] ..... B05D 7/00; G23C 18/00

[52] U.S. Cl. ..... 148/518; 148/253; 148/269; 148/281; 148/282; 428/661; 205/184

[58] Field of Search ..... 148/13, 253, 269, 281, 148/282; 428/661

[56] References Cited

U.S. PATENT DOCUMENTS

| | | | |
|---|---|---|---|
| 3,887,732 | 6/1975 | Parker et al. | 148/253 |
| 4,371,589 | 2/1983 | Warner et al. | 428/661 |
| 4,588,480 | 5/1986 | Thoma | 204/37.1 |
| 4,761,346 | 8/1988 | Naik et al. | 428/661 |
| 4,820,591 | 4/1989 | Ramnarayanan | 428/66 |
| 4,857,116 | 8/1989 | Allam et al. | 148/282 |
| 4,863,810 | 9/1989 | Bhattacharya et al. | 428/661 |
| 4,902,535 | 2/1990 | Garg et al. | 427/249 |
| 5,009,966 | 4/1991 | Garg et al. | 428/632 |

FOREIGN PATENT DOCUMENTS

| | | |
|---|---|---|
| 3321231 | 12/1984 | Fed. Rep. of Germany . |
| 64-79397 | 3/1989 | Japan . |

OTHER PUBLICATIONS

Computer Search Printout locating the family members of German Patent (DE-C2) No. 3321-3231, Sep. 23, 1991.

*Primary Examiner*—Upendra Roy

*Attorney, Agent, or Firm*—Cushman, Darby and Cushman

[57] ABSTRACT

A titanium-containing metallic material having a high heat-resistant and abrasion resistant surface is produced by (A) cleaning a titanium-containing metallic material, (B) first plating the cleaned surface of the metallic material with Cu or Ni by a strike or flash plating method, (C) second plating the first plated surface of the Ti-containing material with Ni, Ni-P alloy or a composite material comprising a Ni-P alloy matrix and fine ceramic particles dispersed in the matrix by an electroplating method, (D) non-oxidatively heat treating the second plated Ti-containing material at 450° C. or more for one hour or more, (E) surface activating the second plated surface of the Ti-containing material, (F) coating the activated surface of the Ti-containing material with a heat and abrasion resistant coating layer comprising a matrix consisting of a Ni-P alloy or cobalt and fine ceramic particles dispersed in the matrix, and optionally, (G) surface-roughening the heat and abrasion-resistant coating layer surface of the Ti-containing material to a $R_Z$ of 1.0 to 10.0 μm, and (H) coating the roughened surface of the Ti-containing material with a solid lubricant coating layer comprising at least one member selected from $MoS_2$, graphite, boron nitride and F-containing polymer resin.

15 Claims, 4 Drawing Sheets

×520

×520

PROCESS FOR SURFACE TREATMENT TITANIUM-CONTAINING METALLIC MATERIAL

BACKGROUND OF THE INVENTION

1) Field of the Invention

The present invention relates to a process for surface treating a titanium-containing metallic material. More particularly, the present invention relates to a process for surface treating a titanium containing metallic material to form a composite coating layer having an excellent heat resistance, abrasion resistance, and optionally, a high sliding property, and closely adhered to a surface of the titanium-containing metallic material surface.

2) Description of the Related Arts

It is known that various titanium-containing metallic materials, for example, titanium or titanium alloy materials, are usable for producing various valve parts and driving system parts of automobiles and autobicycles, for example, engine valves, valve springs, valve retainers, connecting rods, rocker arms and valve lifters, which must be light, and parts of pumps for chemical industries, which must have a high resistance to corrosion.

The titanium-containing metallic materials frequently must have a high heat resistance and abrasion resistance, and optionally, an excellent sliding property.

In the conventional titanium-containing metallic materials, the abrasion resistant coating layer is formed by dry plating methods, for example, gas nitriding method, salt bath nitriding method, ion-nitriding method, ion-plating method, chemical vapor deposition (CVD) method and physical vapor deposition (PVD) method, or by wet plating methods including a pre-treating step by a Marchall method, Thoma method or ASTM method.

The above-mentioned conventional nitriding methods are disadvantageous in that the treated material is greatly deformed due to a high treating temperature, which causes a high thermal strain of the material, and that it takes a long time to form the nitrided hard layer, and thus the productivity of the hardened layer is low.

Also, the conventional dry and wet plating methods are disadvantageous in that the resultant coating layer exhibits a low adhering strength to the titanium or titanium alloy material, and thus is easily separated during practical use.

This easily separable coating layer cannot exhibit a high resistance to severe wear conditions.

Namely, a high wear resistant coating layer should have a high abrasion resistance, a high sliding property, and a high close adhering property to the titanium-containing metallic material surface.

Japanese Unexamined Patent Publication No. 1-79,397 discloses a process for forming a high abrasion-resistant coating layer on a titanium or titanium alloy material by utilizing a Martin-Thoma method.

This process is disadvantageous in that, since a heat-treatment in an oxidative gas atmosphere is applied to a titanium or titanium alloy material plated with a metal, for example, nickel, by a chemical deposition method, the plated metal layer is oxidized in the heat treatment, and thus the oxidized portion of the plated metal layer must be eliminated before an additional metal coating layer, for example, a chromium coating layer, is formed on the metal (nickel) coating layer. Also, this additional chromium coating layer, which forms an outer most layer of the surface treated material exhibits a poor anti-seizing property and unsatisfactory heat and abrasion resistances.

SUMMARY OF THE INVENTION

An object of the present invention is to provide a process for surface treating a titanium-containing metallic material to form a composite coating layer having an excellent heat resistance and abrasion resistance, and a satisfactory sliding property, and closely and firmly adhered to a surface of the titanium-containing metallic material.

Another object of the present invention is to provide a process for surface treating a titanium-containing metallic material to form a composite coating layer having a satisfactory anti-seizing property on a surface of the titanium-containing metallic material, without causing an undesirable oxidation of a plated metal layer.

The above-mentioned objects can be attained by the process of the present invention for surface treating a titanium-containing metallic material, which comprises the steps of:

(A) cleaning a surface of a titanium-containing metallic material;

(B) first, plating the resultant cleaned surface of the titanium-containing metallic material with a member selected from the group consisting of copper and nickel;

(C) second, plating the resultant first plated surface of the titanium-containing metallic material with a member selected from the group consisting of nickel, nickel-phosphorus alloys and composite materials comprising a matrix consisting of a nickel-phosphorus alloy and a number of fine ceramic particles dispersed in the matrix, by an electro-plating method;

(D) non-oxidatively heat-treating the resultant second plated titanium-containing metallic material at a temperature of 450° C. or more for one hour or more;

(E) surface-activating the resultant surface of the non-oxidatively heat-treated titanium-containing metallic material; and (F) coating the resultant surface-activated surface of the titanium-containing metallic material with a heat-resistant and abrasion-resistant coating layer comprising a matrix comprising a member selected from the group consisting of nickel-phosphorus alloys and cobalt and a number of fine ceramic particles dispersed in the matrix.

The process of the present invention optionally further comprises the steps of:

(G) surface-roughening the resultant surface of the heat-resistant and abrasion-resistant coating layer of the coated titanium-containing metallic material, and (H) coating the resultant roughened surface of the coated titanium-containing metallic material with a solid lubricant coating layer comprising at least one member selected from the group consisting of $MoS_2$, graphite, boron nitride and fluorine-containing polymer resins.

DESCRIPTION OF THE PREFERRED EMBODIMENTS

Figure 1:
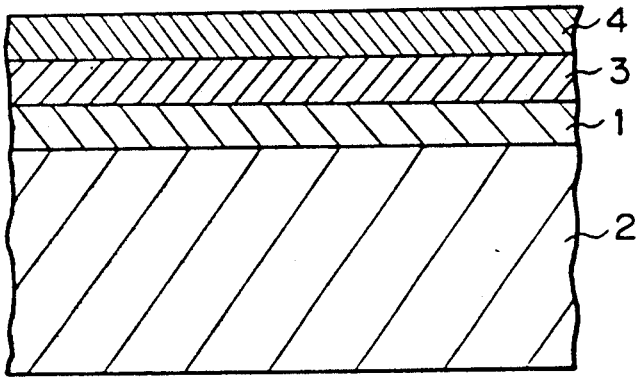
FIG. 1 is an explanatory cross-sectional view of embodiment of a surface treated titanium-containing metallic material produced by the process of the present invention.

The process of the present invention comprises at least a surface-cleaning step (A), a first plating step (B), a second plating step (C), a non-oxidative heat-treating step (D), a surface-activating step (E) and a coating step (F), with a heat resistant and abrasion-resistant coating step.

In the process of the present invention, a surface of a titanium-containing metallic material, for example, a titanium or titanium alloy material, is cleaned by a surface-cleaning step.

The cleaning step includes, for example, a shot blasting operation in which ceramic particles, for example, alumina particles, are shot-blasted toward the surface of the titanium-containing metallic material, a degreasing operation using at least one member selected from alkali solutions, detergent solutions and organic solvents, a pickling operation using an aqueous acid solution, and washing operations with water.

The pickling operation can be effected by treating the surface of the titanium-containing metallic material with a pickling liquid consisting of, for example, an aqueous solution of about 15% by weight of hydrochloric acid or about 10% by weight of hydrofluoric acid, at room temperature for a time of from 10 seconds to 10 minutes, for example, about 30 seconds, and then washing the pickled surface with water.

The surface-cleaning step effectively enhances the close-adhering property of the surface of the titanium-containing metallic material to the plated metal layer in the following first plating step.

When an oily substance, for example, grease, is attached to the surface of the titanium-containing metallic material, the oily substance is preferably removed with an alkali aqueous solution or an organic solvent vapor, for example, trichloroethylene vapor, prior to the shot-blasting operation.

In the first plating step (B), the cleaned surface of the titanium-containing metallic material is plated with copper or nickel. This first plating step is carried out by a strike-plating treatment or flash-plating treatment using a chemical substitution method.

The strike-plating treatment with copper, can be effected by using an aqueous plating solution containing, for example, 60 g/l of copper sulfate, 160 g/l of sodium potassium tartrate (Rochelle salt), and 50 g/l of sodium hydroxide.

The strike-plating treatment with nickel can be carried out by employing an aqueous plating solution containing, for example, 100 g/l of nickel chloride and 30 g/l of hydrochloric acid.

The strike-plating treatment with copper or nickel is carried out by bringing the strike-plating liquid into contact with the cleaned surface of the titanium-containing metallic material, and flowing an electric current through the strike-plating liquid.

Preferably, the strike-plated metal (copper or nickel) layer has a thickness of 1 to 5 μm, more preferably 1 to 3 μm.

When the thickness is less than 1 μm, the resultant strike-plated metal layer sometimes does not completely cover the surface of the titanium-containing metallic material. Also, when the thickness is more than 5 μm, the formation of this thick strike-plated metal layer requires a very long time, and thus is not economical.

The flash-plating treatment with copper can be carried out by using an aqueous treating liquid containing, for example, 10 g/l of copper sulfate, 10 g/l of sodium hydroxide, 20 ml/l of a 37% formaldehyde aqueous solution and 20 g/l of ethylenediaminetetraacetic acid (EDTA), at a predetermined plating temperature, for example, 45° C., using a chemical substitution method.

The flash-plating treatment with nickel can be carried out by using an aqueous plating liquid containing, for example, 30 g/l of nickel chloride, sodium hypophosphite and 10 g/l of sodium citrate, at a predetermined plating temperature, for example, 60° C., using a chemical substitution method.

Preferably, the flash-plated metal layer has a thickness of 0.1 to 2 μm, more preferably 0.1 to 1 μm.

When the thickness is less than 0.1 μm, the resultant flash plated metal layer has an uneven thickness. Also, a thickness of more than 2 μm makes no extra contribution to the plating effect of the flash-plated copper or nickel layer, and thus is not economical.

The copper or nickel layer formed by the strike- or flash-plating treatment and having the above-mentioned thickness effectively enhances the close-adherence of the titanium-containing metallic material to the composite coating layer formed thereon.

In the second plating step (C) of the process of the present invention, the first plated metal layer surface of the titanium-containing metallic material is electroplated with a member selected from nickel, nickel-phosphorus alloys and composite materials comprising a matrix consisting of a nickel-phosphorus alloy and a number of fine ceramic particles dispersed in the matrix.

The second plating step (C) with nickel can be carried out by using an aqueous electroplating liquid containing, for example, 800 g/l of nickel sulfamate, 15 g/l of nickel chloride and 30 g/l of boric acid, and flowing an electric current therethrough.

The second plating step (C) with a nickel-phosphorus alloy can be carried out by employing an aqueous electroplating liquid containing, for example, 800 g/l of nickel sulfamate, 15 g/l of nickel chloride, 30 g/l of boric acid, 3 g/l of sodium hypophosphorite, and flowing an electric current therethrough.

The second plating step (C) with a nickel-phosphorus alloy-ceramic particle composite material can be effected by using an aqueous electroplating liquid containing, for example, the same compounds as those contained in the nickel-phosphorus alloy plating liquid and fine ceramic particles dispersed in the liquid. The fine ceramic particles preferably comprise at least one member selected from SiC, $Si_3N_4$, BN, $Al_2O_3$, WC, $ZrB_2$, diamond and CrB.

In the second plating step (C), the temperature of the electroplating liquid, current density to be applied to the electroplating liquid, and the plating times are adjusted to desired values in consideration of the composition of the electroplating liquid and the desired thickness of the second plated metallic layer.

There is no specific limitation of the thickness of the second plated metallic layer, but preferably the thickness of the second plated metallic layer is controlled to a value of 5 to 30 μm.

The second plated metallic layer having a thickness of 5 to 30 μm is effective for alloying together with the first plated metal layer with titanium in a surface portion of the titanium-containing metallic material to form a Ti-Ni or Ti-Cu alloy layer comprising, for example, $Ti_2Ni$, TiNi, $TiNi_2$, $TiN_3$, TiCu, $TiCu_2$ or $TiCu_4$, in the next non-oxidative heat-treating step (D). This alloy layer is very effective for obtaining a close and firm adherence of the titanium-containing metallic material to the composite coating layer formed by the process of the present invention.

When the thickness is less than 5 μm, the resultant second plated metallic layer sometimes does not exhibit a satisfactory adhesion-enhancing effect.

Where the thickness is increased to a value of more than 30 μm, the adhesion-enhancing effect of the second plate metallic layer is not increased and the cost of forming the second plated metallic layer is needlessly increased.

In the second plating step (C) of the process of the present invention, the resultant plated nickel layer exhibits a satisfactory hardness at a temperature of up to about 200° C., and the resultant plated nickel-phosphorus alloy layer exhibits a satisfactory hardness at a temperature of up to about 350° C.

In the second plating step (C), the type of the metal to be plated is selected in consideration of the composition of the heat resistant and abrasion resistant coating layer which will be formed on the second plated metal layer in the coating step (F).

The second plated titanium-containing metallic material is subjected to a non-oxidative heat treating step (D) in a non-oxidative atmosphere at a temperature of 450° C. or more, preferably from 450° to 850° C., for one hour or more.

The non-oxidative heat treating step (D) is effective for alloying a portion of titanium in the surface portion of the titanium-containing metallic material with nickel and/or copper in the first and second plated metal layers without oxidizing the first and second plated metal layers, to form a titanium alloy layer located between the titanium-containing metallic material and the first and second-plated metal layers. This titanium alloy layer is effective for obtaining a close and firm adherence of the titanium-containing metallic material to the composite coating layer formed by the process of the present invention.

When the heat treating temperature is less than 450° C., or the heat treating time is less than one hour, the resultant titanium alloy layer has an undesirably small thickness.

In an embodiment of the process of the present invention, the non-oxidative heat treating step (D) is carried out under a vacuum pressure of from $10^{-1}$ to $10^{-5}$ Torr. When the vacuum pressure is more than $10^{-1}$ Torr, the plated metal layers formed in the first and second plating steps (B) and (C) are sometimes undesirably oxidized. Also, a vacuum pressure of less than $10^{-5}$ Torr is generated at an increased cost, and is unnecessary for the heat treating step (D) of the present invention.

In another embodiment of the process of the present invention, the non-oxidative heat treating step (D) is carried out in an inert or reductive gas atmosphere comprising at least one member selected from the group consisting of nitrogen, argon and hydrogen.

In this inert or reductive gas atmosphere, the content of oxygen is preferably restricted to a level not exceeding 1% by volume. If the content of oxygen is more than 1% by volume, sometimes the cleaned surface of the titanium-containing metallic layer and the first and second plated metal layers are undesirably oxidized.

The non-oxidative heat treating step (D) in the inert or reductive gas atmosphere is effective for obtaining a glossy surface of the second plated metal layer.

In the non-oxidative heat treating step (D), the titanium alloy layer is formed between the titanium-containing metallic material and the first and second plated metal layers without oxidizing the first and second plated metal layers. Therefore, the surface of the second plated metal layer can be effectively activated by the next surface activating step (E) and the activated surface can be firmly and closely adhered to a heat resistant and abrasion resistant coating layer formed in the coating step (F). These phenomena were discovered for the first time by the present inventors.

The non-oxidatively heat treated titanium-containing metallic material is subjected to a surface activating step (E). This surface-activating treatment is not limited to a specific method, as long as the treatment is effective for the surface activation of the second plated metal layer surface.

This surface activating step (E) can be effected, for example, by a simple treatment such that the surface of the non-oxidatively heat treated titanium-containing metallic material is brought into contact with a surface-activating aqueous solution containing 3 to 10% by weight of hydrofluoric acid and 50 to 70% by weight of nitric acid, at room temperature for 2 to 5 seconds.

This surface activating step (E) is effective for micro-etching the non-oxidatively heat treated surface of the second plated metal layer to enhance the close adherence of the second plated metal layer surface to the heat resistant and abrasion resistant coating layer which will be formed in the next coating step (F).

The surface activated titanium-containing metallic material is subjected to a coating step (F) in which a heat resistant and abrasion resistant coating layer is formed on the surface activated surface of the second plated metal layer.

The heat resistant and abrasion resistant coating layer comprises a matrix composed of a member selected from the group consisting of nickel-phosphorus alloys and cobalt, and a number of fine ceramic particles dispersed in the matrix.

The fine ceramic particles preferably comprise at least one member selected from the group consisting of SiC, $Si_3N_4$, BN, $Al_2O_3$, WC, $ZrB_2$, diamond and CrB. Those fine ceramic particles preferably have an average particle size of from 0.1 to 10.0 μm.

When the average size is less than 0.1 μm, the resultant coating layer sometimes exhibits an unsatisfactory abrasion resistance and sliding property. Also, when the average size is more than 10.0 μm, it is difficult to uniformly disperse the resultant ceramic particles in the matrix.

In the preparation of the coating layer, the surface activated titanium-containing metallic material is subjected to an electroplating operation in a composite electroplating liquid which contains a matrix aqueous solution of metallic compounds for forming the matrix and the fine ceramic particles dispersed in the matrix aqueous solution.

When the matrix consists essentially of a nickel-phosphorus alloy, the matrix aqueous solution comprises, for example, 800 g/l of nickel sulfamate, 15 g/l of nickel chloride, 30 g/l of boric acid and 3 g/l of hypophosphorite.

When the matrix consists essentially of cobalt, the matrix aqueous solution contains, for example, 300 g/l of cobalt sulfamate, 15 g/l of cobalt chloride and 30 g/l of boric acid.

The fine ceramic particles are dispersed preferably in an amount of from 50 to 300 g/l, for example, 200 g/l, in the matrix aqueous solution.

The surface activated titanium containing metal material is brought into contact with the above-mentioned composite electroplating liquid and an electric current is flowed through the electroplating liquid to from a heat resistant and abrasion resistant coating layer on the activated surface.

There is no limitation on the thickness of the heat resistant and abrasion resistant coating layer, but preferably the coating layer has a thickness of 5 to 500 μm. When the thickness is less than 5 μm, the resultant coating layer sometimes exhibits an unsatisfactory abrasion resistance. Also, an thickness of more than 500 μm sometimes affects the adherence of the resultant coating layer to adjacent coating layers.

In the heat resistant and abrasion resistant coating layer, the nickel-phosphorus alloy matrix deposits $Ni_3P$ and hardened by raising the temperature of the coating layer upto about 350° C., and the hardness of the cobalt matrix is not reduced even at a high temperature of about 500° C.

There is no limitation of the content of the fine ceramic particles in the heat resistant and abrasion resistant coating layer, but preferably the content of the fine ceramic particles is from 2 to 20% bared on the total weight of the coating layer.

The fine ceramic particles are preferably selected from those with a high microhardness, for example, SiC particles (microhardness: about 3000, $Si_3N_4$ particles (microhardness: about 2000), WC particles (microhardness: about 2500) and diamond particles (microhardness: about 8000).

The coating layer produced by the coating step (F) of the process of the present invention and containing the fine ceramic particles dispersed in the nickel-phosphorus or cobalt matrix exhibits not only a high heat resistance but also a high abrasion resistance when a sliding force or rubbing force is applied thereto.

In another embodiment of the process of the present invention, the heat resistant and abrasion resistant coating layer-coated titanium-containing metallic material is subjected to the steps of (G) surface-roughening the surface of the heat resistant and abrasion resistant coating layer of the coated titanium-containing metallic material, and then (H) coating the resultant roughened surface of the coated titanium-containing metallic material with a solid lubricant coating layer comprising at least one member selected from the group consisting of molybdenum disulfide ($MoS_2$), graphite boron nitride and fluorine-containing polymer resins.

In the surface roughening step (G), the method of the surface roughening treatment is not limited to a specific method. For example, the surface roughening step (G) can be effected by applying a sandblast treatment with fine alumina particles with a grid number of from 120 to 270, to the surface of the heat resistant and abrasion resistant coating layer of the coated titanium-containing metallic material.

The roughened surface is effective for closely and firmly adhering the heat resistant and abrasion resistant coating layer to the solid lubricant coating layer in the next coating step (H).

The roughened surface preferably has a surface roughness ($R_Z$) of from 1.0 to 10.0 μm, determined in accordance with Japanese Industrial Standard (JIS) B0601.

When the surface roughness ($R_Z$) is less than 1.0 μm, the resultant roughened surface sometimes exhibits an unsatisfactory close adherence to the solid lubricant coating layer. Also, an increase in the surface roughness to a value of more than 10.0 μm does not contribute to an increase of the close adherence of the heat resistant and abrasion resistant coating layer to the solid lubricant coating layer and is disadvantageous in that the tolerance in the dimension of the resultant product becomes large.

The surface roughened titanium-containing metallic material is finally coated with a solid lubricant coating layer comprising at least one member selected from $MoS_2$, graphite, boron nitride and fluorine-containing polymer resins, and the resultant solid lubricant coating layer is cured at a predetermined temperature of, preferably from 150° C. to 250° C.

If necessary, the roughened surface of the heat resistant and abrasion resistant coating layer is cleaned with, for example, an alkali aqueous solution or an organic solvent, before subjecting it to the solid lubricant coating step (H).

There is no restriction of the thickness of the solid lubricant coating layer, but preferably the thickness is from 5 to 30 μm. When the thickness is in this range, the resultant solid lubricant coating layer has a high durability and exhibits a satisfactory sliding property over a long term.

FIG. 1 is an explanatory cross section of the surface treated titanium-containing metallic plate produced in accordance with the process of the present invention.

In FIG. 1, a titanium alloy layer 1 is formed on a titanium-containing metallic plate 2. This titanium alloy layer 1 was produced by an non-oxidative heat treatment of a first and second plated titanium-containing metallic plate. In the heat treating step (D), nickel or copper in the first plated metal layer was alloyed with titanium to form an titanium alloy layer 1. This titanium alloy layer 1 is covered by a second plated metallic layer 3, and further covered by a heat resistant and abrasion resistant coating layer 4.

Figure 2:
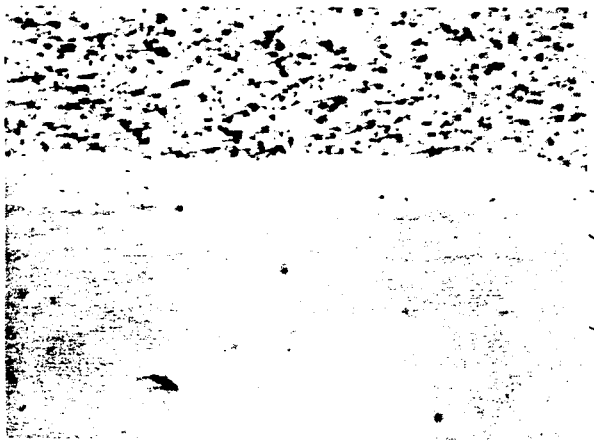
FIG. 2 is a microscopic view of a cross-section of a surface treated titanium plate produced in accordance with the process of the present invention.

FIG. 2 is a microscopic view of a cross-section of a surface treated titanium-containing metallic material produced in accordance with the process of the present invention at a magnification of 520. This surface-treated material was prepared by first plating a surface of a titanium plate (second type, JIS) with a strike plated copper layer; second plating the surface of the first plated copper layer with an electroplated nickel-phosphorus alloy layer; non-oxidatively heat treating the second plated titanium plate under a vacuum pressure of $10^{-3}$ Torr at a temperature of 850° C. for 3 hours; surface activating the heat-treated titanium plate with an activating liquid; and coating the surface of the heat treated titanium plate with a heat resistant and abrasion resistant coating layer comprising a matrix consisting of nickel-phosphorus alloy and fine SiC particles in an amount of 5% by weight based on the total weight of the coating layer.

In view of FIG. 2, a titanium-copper alloy layer copper having a thickness of about 15 μm is closly adhered and firmly bonded to the titanium plate, and coated with a plated nickel-phosphorus alloy layer having a thickness of about 20 μm, and then with a heat resistant and abrasion resistant layer comprising a nickel phosphorus alloy matrix and SiC particles dispersed in the matrix and having a thickness of about 50 μm.

As an example, a surface treated titanium plate was produced in accordance with the process of the present invention, by first plating a cleaned surface of a titanium plate (second type, JIS) with a strike plated copper layer having a thickness of 2 μm; second electroplating the surface of the first plated titanium plate with a nickel-phosphorus alloy layer having a thickness of 20 μm; heat treated the second plated titanium plate under the conditions shown in Table 1; surface activating the heat treated titanium plate with an aqueous solution containing 5% by weight of hydrofluorite (HF) and 60% by weight of nitric acid ($HNO_3$) at room temperature for 3 seconds; washing the activated surface with water; and coating the activated surface with a heat resistant and abrasion resistant coating layer comprising a nickel-phosphorus alloy matrix and SiC particles having an average size of 4.5 μm and in an amount of 5% based on the total weight of the coating layer and having a thickness of 50 μm.

A specimen (having a length of 100 m, a width of 50 mm and a thickness of 2.0 mm) of the resultant surface treated titanium plate was subjected to a bending test by using a bending test machine at a cross head speed of 10 mm/min and at a cross head falling distance of 10 mm, to evaluate the adherence of the resultant composite coating layer to the titanium plate.

The resultant composite coating layer exhibited the adhering property as shown in Table 1 to the titanium plate.

TABLE

| Run No. | Conditions of heat treatment: Type | Temperature (°C.) | Time (hr) | Vacuum pressure (Torr) | Adherence of heat treated surface (class(*)) |
|---|---|---|---|---|---|
| 1 | Vacuum | 250 | 3 | $10^{-5}$ | 1 |
| 2 | " | 450 | 3 | $10^{-5}$ | 3 |
| 3 | " | 650 | 3 | $10^{-5}$ | 3 |
| 4 | " | 850 | 1 | $10^{-5}$ | 3 |
| 5 | " | 450 | 3 | $10^{-2}$ | 3 |
| 6 | " | 850 | 1 | $10^{-3}$ | 3 |
| 7 | " | 850 | 1 | $10^{0}$ | 2 |
| 8 | Oxidative | 450 | 5 | — | 1 |
| 9 | " | 650 | 5 | — | 1 |
| 10 | None | | | | 1 |

Note: (*)
Class 3 . No separation of composite coating layer
Class 2 Partial separation of composite coating layer
Class 1 Separation of most of composite coating layer In run Nos. 2 to 5, which were carried out in accordance with the process of the present invention, the resultant composite coating layers exhibited a strong adherence to the titanium plate.

Figure 3:
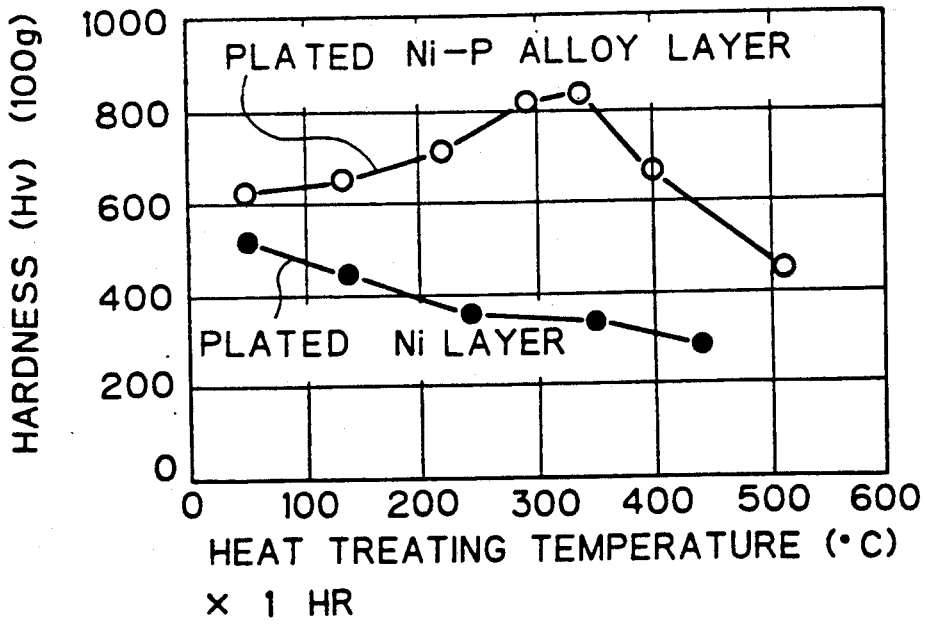
FIG. 3 is a graph showing a relationships between the hardness of the non-oxidatively heat treated nickel and nickel-phosphorus alloy layers formed in step (D) of the process of the present invention, and a non-oxidative heat treating temperature applied to the layers.

In another example, FIG. 3 shows the relationships between the hardnesses of second plated nickel and nickel-phosphorus alloy layers having a thickness of 50 μm and the heat treating temperature.

FIG. 3 clearly shows that the hardness of the nickel-phosphorus alloy layer increases with an increase in the heat-treating temperature of from about 50° C. to about 350° C., while the hardness of the nickel layer decrease with an increase in the heat-treating temperature. Namely, the nickel-phosphorus alloy layer exhibits a higher heat resistance than that of the nickel layer.

In still another example, abrasion test pins were prepared in accordance with the process of the present invention by surface cleaning test pins comprising a 6Al-4V-Ti alloy and having a diameter of 10 mm, first plating, second plating and surface activating in the same manner as mentioned above for the surface treated titanium plate, and coating the surface activated pins with the coating layers having the compositions as shown in Table 2.

The resultant pins were immersed in a lubricating oil (100 ml, trademark: SF-10W-30, made by Kyodo Sekiyu) and then subjected to an abrasion test with an abrading block made from a A2017 aluminum alloy by using a falex abrasion test machine at an abrasion speed of 0.39 m/sec, under a load which was increased stepwise by 25 kg every one minute.

A critical value of the load at which the testing pin was seized to the block was measured, and the results are shown in Table 2.

TABLE 2

| Run No. | Type of coating layer | Critical seizing load (kg) |
|---|---|---|
| 11 | Ni—P/SiC(*)$_2$ | >250 |
| 12 | Ni—P/$Si_3N_4$(*)$_3$ | >250 |
| 13 | Co/$ZrB_2$(*)$_4$ | >250 |
| 14 | Ni (non-electroplated((*)$_5$ | 125 |
| 15 | Hard Cr(*)$_6$ | 150 |
| 16 | $MoS_2$ solid lubricant(*)$_7$ | 25 |
| 17 | Non-coated | 125 |

Note:
(*)$_2$This coating layer comprised a Ni—P alloy matrix and 5% by weight of SiC particles and had a thickness of 20 μm.
(*)$_3$This coating layer comprised a Ni—P alloy matrix and 5% by weight of $Si_3N_4$ particles and had a thickness of 20 μm.
(*)$_4$. This coating layer comprised a Co matrix and 2% by weight of $ZrB_2$ particles and had a thickness of 20 μm.
(*)$_5$This non-electroplated coating layer comprised Ni alone and had a thickness of 20 μm.
(*)$_6$This hard Cr layer had a thickness of 20 μm.
(*)$_7$This solid lubricant coating layer comprised $MoS_2$ and had a thickness of 20 μm.

The coating layers of run Nos. 11 to 12 produced in accordance with the process of the present invention exhibited a very high anti-seizing property and sliding property.

In another example of the process of the present invention, abrasion testing pins were produced by the same procedures as mentioned above, except that a heat resistant and abrasion resistant coating layer had a composition as shown in Table 3, and surface roughened by a shot blast treatment under the conditions as shown in Table 3 and then coated with a solid lubricant coating layer as shown in Table 3, and the testing pins were subjected to the abrasion test without treating with the lubricating oil.

The abrasion test was carried out by using a falex abrasion testing machine and a block consisting of SUJ-2 (hardness: HRC 60, 90° V type) at an abrasion speed of 0.39 m/sec.

In this abrasion test, the load applied to the testing pins was increased stepwise by 65 kg every one minute.

Figure 4:
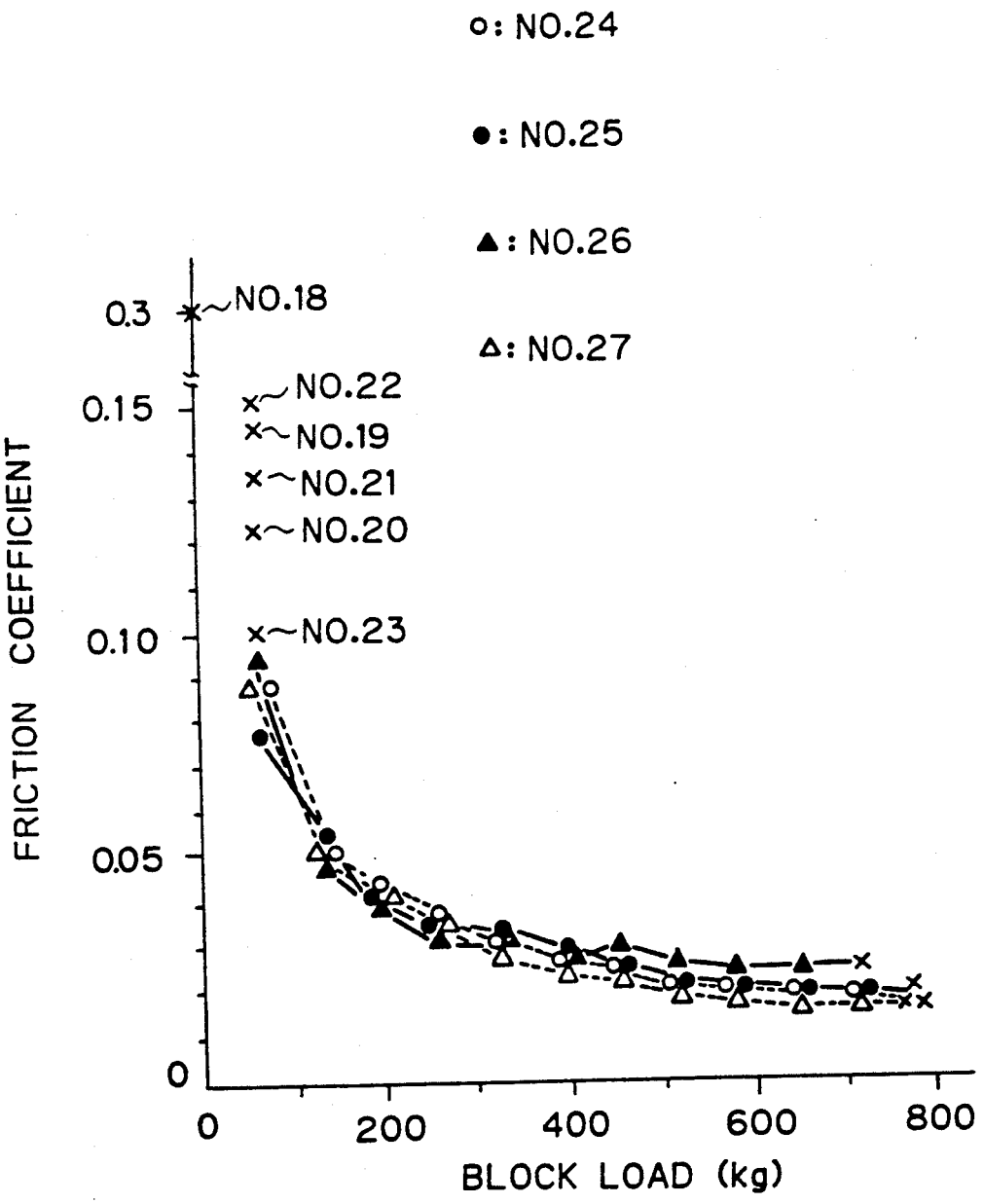
FIG. 4 is a graph showing the relationship between the frictional coefficients of surface treated and non-surface treated titanium alloy pins and the block loads applied to the pins, in an abrasion test; and, FIG. 5 is a graph showing the relationships between the frictional coefficients of surface-treated titanium alloy pins produced in accordance with the process of the present invention, and the block loads applied thereto in an abrasion test, in comparison with those of comparative and referential examples.

The critical seizing loads and friction coefficients of the tested pins are shown in Table 3 and FIG. 4, respectively.

TABLE 3

| Run No. | Heat resistant and abrasion resistant coating layer: Matrix | Fine ceramic particles: Type | Fine ceramic particles: Amount (% wt) | Surface roughening step | Solid lubricant coating layer | Critical seizing load (kg) |
|---|---|---|---|---|---|---|
| 18 | | None | | None | None | <65 |
| 19 | Ni—P | SiC | 5 | None | None | 65 |
| 20 | Ni—P | $Si_3N_4$ | 5 | None | None | 65 |
| 21 | Co | $ZrB_2$ | 2 | None | None | 65 |
| 22 | Co | SiC | 3 | None | None | 65 |
| 23 | | None | | $Al_2O_3$ shot blast(*)9 | FBT-116(*)8 | 65 |
| 24 | Ni—P | SiC | 5 | $Al_2O_3$ shot blast(*)9 | " | 780 |
| 25 | Ni—P | $Si_3N_4$ | 5 | $Al_2O_3$ shot blast(*)9 | " | 780 |
| 26 | Co | $ZrB_4$ | 2 | $Al_2O_3$ shot blast(*) 9 | FH-70(*)10 | 715 |
| 27 | Co | SiC | 3 | $Al_2O_3$ shot blast(*)9 | FMB-4A(*)11 | 780 |

Note:
(*)8FBT-116 is a trademark of a solid lubricant containing fine $MoS_2$ particles dispersed in a binder consisting of a phenol-formal-dehyde resin, made by Kawamura Kenkyusho.
(*)9The surface-roughening step was carried out by a sandblast treatment with alumina particles (grade No. 200) and by washing with an organic solvent.
(*)10FH-70 is a trademark of a solid lubricant containing a fluorine-containing polymer resin particles dispersed in an epoxy resin, made by Kawamura Kenkyusho.
(*)11HMB-4A is a trademark of a solid lubricant containing MoS2 particles dispersed in an polyimide resin.

In run No. 18, the test pin, which was not surface treated, was seized immediately after the start of the abrasion test, as shown in FIG. 4.

In each of run Nos. 19 to 22, the first plated metal layer was formed by a strike plating a cleaned surface of the titanium alloy pin with copper, the second plated metallic layer was formed with a nickel-phosphorus alloy, the non-oxidative heat treating step was carried out under a vacuum pressure of $10^{-3}$ Torr at 500° for 3 hours and the heat resistant and abrasion resistant coating layer had a thickness of 20 μm.

In run Nos. 19 to 22, the resultant composite coating layers, which were free from the solid lubricant layer, exhibited a relatively large friction coefficient of 0.12 to 0.15 as shown in FIG. 4 when the test pins were not treating with a lubricating oil. Also, the test pins without lubricating oil exhibited a relatively low critical seizing load of 65 kg or less as shown in Table 3.

In run No. 23, the titanium alloy pin was directly coated with a solid lubricant coating layer without forming the composite coating layer. In this run, the pin was shot-blasted with alumina particles (grade no. 220), cleaned with an organic solvent, and coated with FBT-116 by a spray method. The solid lubricant coating layer was cured at a temperature of 180° C. for one hour and had a thickness of 10 μm. This solid lubricant coating layer of Run No. 23 exhibited a critical seizing temperature of 65° C. This indicates that the solid lubricant coating layer formed on a surface having a low hardness exhibits an unsatisfactory sliding property and anti-seizing property, and thus the solid lubricant coating layer should be formed on the specific composite coating layer produced by the process of the present invention and having a high hardness.

Run No. 24 to 27 were carried out in accordance with the process of the present invention. The solid lubricant coating layers formed from FBT-116, FH-70 or HMB-4A had a thickness of 10 μm.

The test pins of run Nos. 24 to 27 exhibited a very low frictional coefficient of 0.02 to 0.04 under a block load of 200 kg or more, as shown in FIG. 4, and a very high critical seizing temperature of 715 to 780 kg as shown in Table 3.

EXAMPLES

The process of the present invention will be further explained by the following specific examples.

EXAMPLE 1

A titanium pin consisting of a 6Al-4V-Ti alloy and having a diameter of 10 mm and a length of 35 mm was surface treated by the following steps.

(A) Surface cleaning step

This step (A) was carried out by the following operations:

(i) A shot-blast operation with alumina particles (grade No. 220), (ii) A cleaning operation with trichloroethylene vapor at a temperature of 80° C., (iii) An alkali degreasing operation with an aqueous solution of 50 g/l of Alkali Cleaner FC-315 which was a trademark of an weak alkali cleaning agent made by Nihon Parkerizing Co., at a temperature of 70° C. at an immersion time of 3 minutes, (iv) Washing with water, (v) Pickling with an aqueous solution containing 17% by weight of hydrochloric acid at room temperature for 30 seconds, and (vi) Washing with water (B) First plating step This first plating step was carried out by a strike plating method with copper under the following conditions.

(i) Composition of plating liquid:

| Component | Amount |
|---|---|
| Copper sulfate | 60 g/l |
| Rochelle salt | 160 g/l |
| Sodium hydroxide | 50 g/l |

(ii) Plating temperature: room temperature
(iii) Current density: 0.5 A/dm$^2$
(iv) Thickness of resultant first plated metal layer: 1 μm
(v) Washing with water (C) Second plating step This second plating step was carried out by an electroplating method with a nickel-phosphorus alloy under the following conditions.
(i) Composition of plating liquid:

| Component | Amount |
|---|---|
| Nickel sulfamate | 800 g/l |
| Nickel chloride | 15 g/l |
| Boric acid | 30 g/l |
| Sodium hypophosphite | 3 g/l |

(ii) Plating temperature: 57° C.
(iii) Current density: 20 A/dm$^2$
(iv) Thickness of resultant plated metal layer: 20 μm
(v) Washing with water
(vi) Hot air drying at about 80° C.

(D) Non-oxidative heat treating step

This step was carried out under a vacuum, and under the following conditions:
(i) Vacuum pressure: $10^{-5}$ Torr
(ii) Heat treating temperature: 450° C.
(iii) Heat treating time: 3 hours (E) Surface activating step This step was carried out under the following conditions:
(i) Composition of activating aqueous solution:

| Component | Amount |
|---|---|
| HF | 5% by weight |
| $HNO_3$ | 60% by weight |

(ii) Activating temperature: room temperature
(iii) Activating time: 3 seconds immersion
(iv) Washing with water (F) Coating step In this step, a heat resistant and abrasion resistant coating layer comprising a nickel-phosphorus alloy matrix and SiC particles dispersed in the matrix was produced by an electroplating method under the following conditions:
(i) Composition of electroplating liquid:

| Component | Amount |
|---|---|
| Nickel sulfamate | 800 g/l |
| Nickel chloride | 15 g/l |
| Boric acid | 30 g/l |
| Sodium hypophosphite | 3 g/l |
| SiC | 200 g/l |

(ii) Plating temperature: 57° C.
(iii) Current density: 15 A/dm$^2$
(iv) Thickness of resultant plated metallic layer: 20 μm
(v) Washing with water
(vi) Hot air drying at about 80° C.

The resultant surface treated titanium alloy pin was lubricated with a lubricating oil (available under the trademark of Nisseki Gear Oil EP 90, from Nihon Sekiyu) and subjected to an abrasion test by using a falex abrasion testing machine and a loading block consisting of SUJ-2 (Hardness (HR): C60), at an abrasion speed of 0.39 m/second. In this abrasion test, the block load was increased stepwise by 50 kg every one minute, to determine a critical seizing load at which the testing pin was seized to the block.

The test results are indicated in Table 4.

Example 2

The same procedures as mentioned in Example 1 were carried out, with the following exceptions.

The first plating step (B) were carried out by a strike plating method under the following conditions:
(i) Composition of plating liquid

| Component | Amount |
|---|---|
| Nickel chloride | 100 g/l |
| Hydrochloric acid | 30 g/l |

(ii) Plating temperature: 40° C.
(iii) Current density: 3 A/dm$^2$
(iv) Thickness of resultant plated metal layer: 3 μm
(v) Washing with water The second plating step (C) was carried out by an electroplating method under the following conditions:
(i) Composition of plating liquid:

| Component | Amount |
|---|---|
| Nickel sulfamate | 800 g/l |
| Nickel chloride | 15 g/l |
| Boric acid | 30 g/l |
| Sodium hypophosphite | 3 g/l |
| WC | 200 g/l |

(ii) Plating temperature: 57° C.
(iii) Current density: 15 A/dm$^2$
(iv) Thickness of resultant plated metallic layer: 20 μm
(v) Washing with water
(vi) Hot air drying at about 80° C.

The test results are shown in Table 4.

EXAMPLE 3

The same procedures as mentioned in Example 1 were carried out, with the following exceptions.

The second plating step (C) was carried out by an electroplating method under the following conditions:
(i) Composition of plating liquid:

| Component | Amount |
|---|---|
| Nickel sulfamate | 800 g/l |
| Nickel chloride | 15 g/l |
| Boric acid | 30 g/l |

(ii) Plating temperature: 57° C.
(iii) Current density: 15 A/dm$^2$
(iv) Thickness of resultant plated metallic layer: 20 μm
(v) Washing with water
(vi) Hot air drying at about 80° C.

The coating step (F) with the heat resistant and abrasion resistant coating layer was carried out by an electroplating method under the following conditions.
(i) Composition of plating liquid:

| Component | Amount |
|---|---|
| Cobalt sulfamate | 300 g/l |
| Cobalt chloride | 15 g/l |
| Boric acid | 30 g/l |
| $ZrB_2$ | 200 g/l |

(ii) Plating temperature: 57°C.
(iii) Current density: 15 A/dm$^2$
(iv) Thickness of resultant plated metallic layer: 20 μm
(v) Washing with water
(vi) Hot air drying at about 80°C.
The test results are indicated in Table 4.

Comparative Example 1

The same titanium pin as mentioned in Example 1 was surface treated by the following steps.

(1) Surface cleaning step

This step (A) was carried out in the same manner as in Example 1.

(2) First plating step

This first plating step was carried out by a strike-plating method with copper, under the following conditions.
(i) Composition of plating liquid:

| Component | Amount |
|---|---|
| Copper sulfate | 60 g/l |
| Rochelle salt | 160 g/l |
| Sodium hydroxide | 50 g/l |

(ii) Plating temperature: room temperature
(iii) Current density: 0.5 A/dm$^2$
(iv) Thickness of the resultant first plated metal layer: 1 μm
(v) Washing with water (3) Second plating step This second plating step was carried out by a non-electrolylic plating method with a nickel-phosphorus alloy plating liquid (available under the trademark of NYCO ME PLATING BATH, from Kizai K.K.)
The resultant plated metallic layer was washed with water and dried with hot air at about 80° C. The dried metallic layer had a thickness of 20 μm.

(4) Oxidative heat treating step

This step was carried out under an oxidative atmosphere in a Muffle furnace under the following conditions:
(i) Heat treating temperature: 450° C.
(ii) Heat treating time: 20 hours
(iii) The heat treated pin was immersed in an aqueous solution containing about 33% by weight of nitric acid ($HNO_3$) at room temperature for 15 minutes to eliminate an oxidized portion of the plated metallic layer.
(iv) Washing with water (5) Electroplating step In this step, an electroplating operation with chromium was carried out under the following conditions.
(i) Composition of plating liquid

| Component | Amount |
|---|---|
| $CrO_3$ | 265 g/l |
| $H_2SO_4$ | 1% based on the weight of $CrO_3$ |

(ii) Plating temperature: 45° C.
(iii) Current density: 40 A/m$^2$
(iv) Thickness of resultant plated Cr layer: 20 μm
The resultant surface treated pin was subjected to the same abrasion test as mentioned in Example 1.
The test results are shown in Table 4.

| Example No. | | Critical seizing load |
|---|---|---|
| Example | 1 | The block was worn away under a load of 800 kg. |
| | 2 | The block was worn away under a load of 800 kg. |
| | 3 | The block was worn away under a load of 750 kg. |
| Comparative Example | 1 | The pin was seized under a load of 200 kg. |

Table 4 clearly shows that the composite coating layers of Examples 1 to 3 formed on the titanium alloy pin in accordance with the process of the present invention exhibited an excellent abrasion resistance in comparison with the conventional chromium coating layer of Comparative Example 1.

Example 4

A titanium pin consisting of a 6Al-4V-Ti alloy and having a diameter of 10 mm and a length of 35 mm was surface treated by the following steps.

(A) Surface cleaning step

This step (A) was carried out by the following operations:
(i) A shot blast operation with alumina particles (grade No. 220),
(ii) A cleaning operation with trichloroethylene vapor at a temperature of 80° C.,
(iii) An alkali degreasing operation with an aqueous solution of 50 g/l of Alkali Cleaner FC-315 which was a trademark of an weak alkali cleaning agent made by Nihon Parkerizing Co., at a temperature of 70° C. at an immersion time of 3 minutes,
(iv) Washing with water,
(v) Pickling with an aqueous solution containing 17% by weight of hydrochloric acid at room temperature for 30 seconds,
(vi) Washing with water (B) First plating step This first plating step was carried out by a strike plating method with copper under the following conditions.
(i) Composition of plating liquid:

| Component | Amount |
|---|---|
| Copper sulfate | 60 g/l |
| Rochelle salt | 160 g/l |
| Sodium hydroxide | 50 g/l |

(ii) Plating temperature: room temperature
(iii) Current density: 0.5 A/dm$^2$ (iv) Thickness of the resultant first plated metal layer: 2 μm (v) Washing with water (C) Second plating step This second plating step was carried out by an electroplating method with a nickel-phosphorus alloy under the following conditions.

(i) Composition of plating liquid:

| Component | Amount |
|---|---|
| Nickel sulfamate | 800 g/l |
| Nickel chloride | 15 g/l |
| Boric acid | 30 g/l |
| Sodium hypophosphite | 3 g/l |

(ii) Plating temperature: 57° C.

(iii) Current density: 15 A/dm$^2$ (iv) Thickness of resultant plated metal layer: 10 μm (v) Washing with water (vi) Hot air drying at about 80° C,.

(D) Non-oxidative heat treating step

This step was carried out under a vacuum and under the following conditions:

(i) Vacuum pressure: $10^{-3}$ Torr (ii) Heat treating temperature: 500° C.

(iii) Heat treating time: 3 hours (E) Surface activating step

This step was carried out under the following conditions:

(i) Composition of activating aqueous solution:

| Component | Amount |
|---|---|
| HF | 5% by weight |
| $HNO_3$ | 60% by weight |

(ii) Activating temperature: room temperature (iii) Activating time: 3 seconds immersion (iv) Washing with water (F) Coating step In this step, a heat resistant and abrasion resistant coating layer comprising a nickel-phosphorus alloy matrix and SiC particles dispersed in the matrix was produced by an electroplating method under the following conditions:

(i) Composition of electroplating liquid:

| Component | Amount |
|---|---|
| Nickel sulfamate | 800 g/l |
| Nickel chloride | 15 g/l |
| Boric acid | 30 g/l |
| Sodium hypophosphite | 3 g/l |
| SiC | 200 g/l |

(ii) Plating temperature: 57° C.

(iii) Current density: 15 A/dm$^2$ (iv) Thickness of resultant plated metallic layer: 20 μm (v) Hot air drying at about 80° C.

(G) Surface roughening step

In this step (G), the coated surface of the pin was roughened by a shot blast treatment with alumina particles (grid No. 200), and then cleaned with trichloroethylene vapor.

(H) Solid lubricant coating step

A solid lubricating liquid (available under the trademark of FBT-116 (Defric Coat)) was sprayed onto the roughened surface of the pin to form a solid lubricant coating layer having a dry thickness of 10 μm.

The solid lubricant coating layer was cured at 180° C. for one hour.

The resultant surface treated pin was subjected to the same abrasion test as mentioned in Example 1, with the following exceptions.

The lubricating oil was not applied to the surface treated pin, and thus the pin was tested in a dry condition.

The abrasion speed was 0.13 m/sec.

The load was increased stepwise by 32 kg every one minute.

The critical seizing load of the tested pin is indicated in Table 5.

Figure 5:
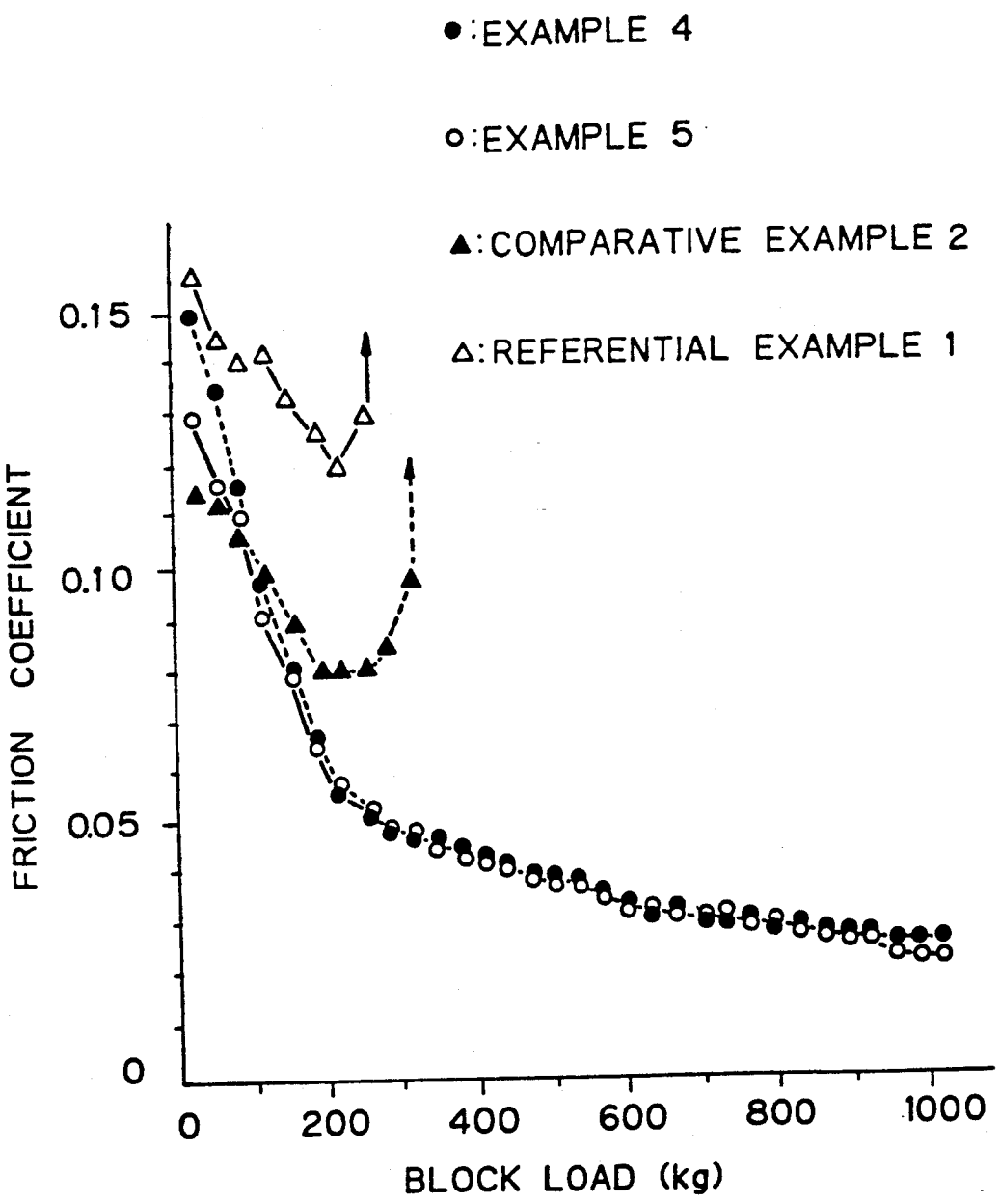

Also, the frictional coefficients of the tested pin under various loads are shown in FIG. 5.

Example 5

The same procedures as mentioned in Example 4 were carried out with the following exceptions.

The coating step (F) was carried out under the following conditions.

(i) Composition of plating liquid

| Component | Amount |
|---|---|
| Cobalt sulfamate | 300 g/l |
| Cobalt chloride | 15 g/l |
| Boric acid | 30 g/l |
| SiC | 200 g/l |

(ii) Plating temperature: 57° C.

(iii) Current density: 15 A/dm$^2$ (iv) Thickness of resultant plated metallic layer: 20 μm The test results are shown in Table 5 and FIG. 5.

Comparative Example 2

The same titanium alloy pin as mentioned in Example 4 was surface treated by the following steps.

The surface of the pin was cleaned by applying a shot blast treatment with alumina particles (grid No. 220), and treating with trichloroethylene vapor at a temperature of 80° C.

The cleansed surface was coated with the same solid lubricant coating layer as described in Example 4 and having a thickness of 10 μm, and the resultant coating layer was cured at 180° C. for one hour.

The test results are shown in Table 5 and FIG. 5.

REFERENTIAL EXAMPLE 1

The same titanium alloy pin as mentioned in Example 4 was surface treated by the same treating steps (A), (B), (C), (D), (E) and (F) as mentioned in Example 4.

The resultant surface treated pin was subjected to the same abrasion test as in Example 4.

The test results are shown in Table 5 and FIG. 5.

TABLE 5

| Example No. | Critical seizing load (kg) |
|---|---|
| Example | |

TABLE 5-continued

| Example No. | Critical seizing load (kg) |
|---|---|
| 4 | >1024 |
| 5 | >1024 |
| Comparative Example 2 | 320 |
| Referential Example 1 | 256 |

Table 5 shows that the surface treated titanium alloy pins of Examples 4 and 5 produced in accordance with the process of the present invention exhibited a very high critical seizing load of more than 1000 kg even when no lubricating oil was applied thereto, whereas the pins of Comparative Example 2 and Referential Example 1 were seized under relatively low loads of 320 kg and 256 kg, respectively.

Also, FIG. 5 shows that the titanium alloy pins of Examples 4 and 5 exhibited a very low friction coefficient of from 0.02 to 0.03 under a high load of more than 800 kg, whereas the pins of Comparative Example 2 and Referential Example 1 exhibited a high frictional coefficient of more than 0.07 under a relatively low load of 300 kg or less.

EXAMPLE 6

A titanium plate (JIS Class 2) having a width of 50 mm, a length of 100 mm and a thickness of 2.0 mm was surface treated by the following steps.

(A) Surface cleaning step

This step (A) was carried out by the following operations:

(i) A shot blast operation with alumina particles (grade No. 220), (ii) A cleaning operation with trichloroethylene vapor at a temperature of 80° C., (iii) An alkali degreasing operation with an aqueous solution of 50 g/l of Alkali, Cleaner FC-315 which was a trademark of a weak alkali cleaning agent made by Nihon Parkerizing Co., at a temperature of 70° C. at an immersion time of 3 minutes, (iv) Washing with water, (v) Pickling with an aqueous solution containing 17% by weight of hydrochloric acid at room temperature for 30 seconds, and (vi) Washing with water

(B) First plating step

This first plating step was carried out by a flash plating treatment in a chemical substitution method with copper under the following conditions.

(i) Composition of plating liquid:

| Component | Amount |
|---|---|
| Copper sulfate | 10 g/l |
| Sodium hydroxide | 10 g/l |
| 37% formaldehyde aqueous solution | 20 ml/l |
| EDTA | 20 g/l |

(ii) Plating temperature: 45° C.

(iii) Thickness of the resultant first plated metal layer: 0.7 μm (iv) Washing with water

(C) Second plating step

This second plating step was carried out by an electroplating method with a nickel-phosphorus alloy under the following conditions.

(i) Composition of plating liquid:

| Component | Amount |
|---|---|
| Nickel sulfamate | 800 g/l |
| Nickel chloride | 15 g/l |
| Boric acid | 30 g/l |
| Sodium hypophosphite | 3 g/l |

(ii) Plating temperature: 57° C.

(iii) Current density: 20 A/dm$^2$ (iv) Thickness of resultant plated metal layer: 20 μm (v) Washing with water (vi) Hot air drying at about 80° C.

(D) Non-oxidative heat treating step

This step was carried out under a vacuum and under the following conditions:

(i) Vacuum pressure: $10^{-4}$ Torr (ii) Heat treating temperature: 600° C.

(iii) Heat treating time: 2 hours

(E) Surface activating step

This step was carried out under the following conditions:

(i) Composition of activating aqueous solution:

| Component | Amount |
|---|---|
| HF | 5% by weight |
| $HNO_3$ | 60% by weight |

(ii) Activating temperature: room temperature (iii) Activating time: 3 seconds immersion (iv) Washing with water

(F) Coating step

In this step, a heat resistant and abrasion resistant coating layer comprising a nickel-phosphorus alloy matrix and SiC particles dispersed in the matrix was produced by an electroplating method under the following conditions:

(i) Composition of electroplating liquid:

| Component | Amount |
|---|---|
| Nickel sulfamate | 800 g/l |
| Nickel chloride | 15 g/l |
| Boric acid | 30 g/l |
| Sodium hypophosphite | 3 g/l |
| SiC | 200 g/l |

(ii) Plating temperature: 57° C.

(iii) Current density: 15 A/dm$^2$ (iv) Thickness of resultant plated metallic layer: 20 μm (iv) Washing with water (v) Hot air drying at about 80° C.

The surface treated titanium plate was subjected to a bending test and an abrasion test.

The bending test was carried out to evaluate the close adhering strength of the resultant composite coating layer to the titanium plate, by using a bending test machine (trademark: YONEKUKA CATY-2002S (for two tons) at a cross head speed of 10 mm/min and at a cross head falling distance of 10 mm.

The test results were evaluated in the following manner.

| Class | Item |
|---|---|
| 4 | No separation of the composite coating layer on the titanium plate occurred until the test piece was broken. Also, no change was found in the composite coating layer. |
| 3 | Until the bend deformation of the test piece reached 10 mm, no separation and no change of the composite coating layer were found. |
| 2 | Until the bend deformation of the test piece reached 10 mm, a portion of the composite coating layer was separated. |
| 1 | Most of the composite coating layer was separated. |

The abrasion test was carried out in the same manner as mentioned in Example 1 and the test results were evaluated in the following manner.

| Class | Item |
|---|---|
| 2 | No seizing of the test piece occurred until the block load reached 800 kg. |
| 1 | The test piece was seized at a block load of 200 kg. |

Also, the heat resistance of the composite coating layer of the test piece was evaluated in the following manner.

| Class | Item |
|---|---|
| 2 | The surface of the test piece had a sufficiently high hardness until the temperature thereof reached 350° C. |
| 1 | The hardness of the surface of the test piece was not satisfactory at a temperature of 200° C. or more. |

The test results are shown in Table 6.

EXAMPLE 7

The same procedures as mentioned in Example 6 were carried out with the following exceptions.

(1) The titanium plate was replaced by a titanium alloy plate consisting of a Ti-6Al-4V alloy and having the same dimensions as in Example 6.

(2) In the first copper flash plating step (B), the thickness of the resultant plated copper layer was changed to 0.2 μm.

(3) In the second plating step (C), the composition of the plating liquid was as follows.

| Component | Amount |
|---|---|
| Nickel sulfamate | 800 g/l |
| Nickel chloride | 15 g/l |
| Boric acid | 30 g/l |
| Sodium hypophosphite | 3 g/l |
| SiC | 200 g/l |

The current density was changed to 15 A/dm$^2$.

In the non-oxidative heat treating step (D), the vacuum pressure was $10^{-2}$ Torr, the heat treating temperature was 450° C. and the heat treating time was 1.5 hours.

The test results are indicated in Table 6.

EXAMPLE 8

The same procedure as described in Example 6 were carried out, with the following exceptions.

In the first flash copper plating step (B), the thickness of the resultant plated copper layer was changed to 1.2 μm.

In the second electroplating step (C), the thickness of the resultant nickel-phosphorus alloy layer was changed to 10 μm.

The non-oxidative heat treating step (D) was carried out under the following conditions.

(i) Vacuum pressure: $10^{-5}$ Torr (ii) Heat treating temperature: 850° C.

(iii) Heat treating time: 1 hour

In the surface activating step (E), the activating (immersing) time was changed to 2 seconds.

In the coating step (F), the SiC was changed to BN in an amount of 200 g/l.

The test results are shown in Table 6.

EXAMPLE 9

The same procedures as described in Example 6 were carried out, with the following exceptions.

The first flash plating step (B) was carried out under the following conditions.

(i) Composition of plating liquid:

| Component | Amount |
|---|---|
| Nickel chloride | 30 g/l |
| Sodium hypophosphite | 10 g/l |
| Sodium citrate | 10 g/l |

(ii) Plating temperature: 60° C.

(iii) Thickness of resultant plated metallic layer: 0.5 μm

The second electroplating step (C) was carried out under the following conditions.

(i) Composition of plating liquid

| Component | Amount |
|---|---|
| Nickel sulfamate | 800 g/l |
| Nickel chloride | 15 g/l |
| Boric acid | 30 g/l |
| Sodium hypophosphite | 3 g/l |
| WC | 200 g/l |

(ii) Plating temperature: 57° C.

(iii) Current density: 15 A/dm$^2$ (iv) Thickness of resultant plated metallic layer: 20 μm The non-oxidative heat treating step (D) was carried out under the following conditions.

(i) Vacuum pressure: $10^{-2}$ Torr (ii) Heat treating temperature: 550° C.

(iii) Heat treating time: 3 hours

In the surface activating step (E), the activating (immersing) time was changed to 5 seconds.

The test results are shown in Table 6.

EXAMPLE 10

The same procedures as those mentioned in Example 6 were carried out with the following exceptions.

The titanium plate was replaced by the same Ti-6Al-4V alloy plate as mentioned in Example 7.

In the first plating step (B), the same nickel flash plating operation as in Example 9 was carried out except that the thickness of the resultant plated nickel layer was changed to 0.2 μm.

The non-oxidative heat treating step (D) was carried out under the following conditions.

(i) Vacuum pressure: $10^5$ Torr (ii) Heat treating temperature: 800° C.

(iii) Heat treating time: 1 hour

The surface activating step was carried out under the same conditions as in Example 9.

The coating step (F) was carried out in the same manner as in Example 8.

The test results are shown in Table 6.

EXAMPLE 11

The same procedures as in Example 6 were carried out, with the following exceptions.

The same titanium alloy plate as in Example 7 was employed.

The first flash plating step (B) was carried out in the same manner as mentioned in Example 9, except that the thickness of the resultant first plated nickel layer was changed to 1.5 μm.

The second electroplating step (C) was carried out under the following conditions.

(i) Composition of plating liquid:

| Component | Amount |
|---|---|
| Nickel sulfamate | 800 g/l |
| Nickel chloride | 15 g/l |
| Boric acid | 30 g/l |
| Sodium hypophosphite | 3 g/l |
| BN | 200 g/l |

(ii) Plating temperature: 57° C.

(iii) Current density: 15 A/dm$^2$ (iv) Thickness of resultant plated metallic layer: 10 μm The non-oxidative heat treating step (D) was carried out under the following conditions.

(i) Vacuum pressure: $10^{-4}$ Torr (ii) Heat treating temperature: 700° C.

(iii) Heat treating time: 1.5 hours.

In the surface activating step (E), the activating (immersion) time was changed to 2 seconds.

In the coating step (F), the SiC in the plating liquid was changed to $Al_2O_3$ particles in an amount of 200 g/l.

The test results are shown in Table 6.

COMPARATIVE EXAMPLE 3

The same procedures as in Example 6 were carried out, with the following exceptions.

The non-oxidative heat treating step (D) was carried out under the following conditions.

(i) Vacuum pressure: $10^{-4}$ Torr (ii) Heat treating temperature: 400° C.

(iii) Heat treating time: 40 minutes

The test results are indicated in Table 6.

COMPARATIVE EXAMPLE 4

The same procedures as in Example 6 were carried out, with the following exceptions.

The first plating step (B) was carried out by a strike plating method with copper under the following conditions.

(i) Composition of plating liquid:

| Component | Amount |
|---|---|
| Copper sulfate | 60 g/l |
| Rochelle salt | 160 g/l |
| Sodium hydroxide | 50 g/l |

(ii) Plating temperature: room temperature (iii) Current density: 0.5 A/dm$^2$ (iv) Thickness of resultant plated copper layer: 1 μm The second electroplating step (C) was replaced by the same non-electrolytic plating treatment as mentioned in Comparative Example 1. The resultant plated nickel-phosphorus alloy layer had a thickness of 20 μm.

The non-oxidative heat treating step (D) was replaced by an oxidative heat treatment in a Muffle furnace at a temperature of 450° C. for 20 hours, and the resultant product was immersed in an aqueous solution containing about 33% by weight of nitric acid at room temperature for 15 minutes to eliminate a resultant oxidized portion of the product, and washed with water.

The surface activating step (E) was omitted.

The coating step (F) was replaced by a chromium electroplating treatment under the following conditions.

(i) Composition of plating liquid:

| Component | Amount |
|---|---|
| $CrO_3$ | 265 g/l |
| $H_2SO_4$ | 1% based on the weight of $CrO_3$ |

(ii) Plating temperature: 45° C.

(iii) Current density: 40 A/dm$^2$ (iv) Thickness of resultant plated Cr layer: 20 μm (v) Washing with water (vi) Hot air drying at about 80° C.

The test results are shown in Table 6.

REFERENTIAL EXAMPLE 2

The same procedures as in Example 6 were carried out, with the following exceptions.

The first plating step (B) was carried out by the same copper strike plating procedure as in Comparative Example 4.

The non-oxidative heat treating step (D) was carried out under the following conditions.

(i) Vacuum pressure: $10^{-5}$ Torr (ii) Heat treating temperature: 450° C.

(iii) Heat treating time: 3 hours

The test results are indicated in Table 6.

REFERENTIAL EXAMPLE 3

The same procedures as in Example 6 were carried out, with the following exceptions.

The first plating step (B) was carried out by a strike plating method with nickel under the following conditions.

(i) Composition of plating liquid:

| Component | Amount |
|---|---|
| Nickel chloride | 100 g/l |
| Hydrochloric acid | 30 g/l |

(ii) Plating temperature: 40° C.

(iii) Current density: 3 A/dm$^2$ (iv) Thickness of the plated nickel layer: 3 μm (v) Washing with water.

The second plating step (C) was carried out in the same manner as described in Example 9.

The test results are shown in Table 6.

TABLE 6

| Example No. | Heat resistance | Abrasion resistance | Close adherence |
|---|---|---|---|
| Example | | | |
| 6 | 2 | 2 | 4 |
| 7 | 2 | 2 | 4 |
| 8 | 2 | 2 | 4 |
| 9 | 2 | 2 | 4 |
| 10 | 2 | 2 | 4 |
| 11 | 2 | 2 | 4 |
| Comparative Example | | | |
| 3 | 2 | 2 | 2 |
| 4 | 1 | 1 | 1 |
| Referential Example | | | |
| 2 | 2 | 2 | 3 |
| 3 | 2 | 2 | 3 |

EXAMPLE 12

A titanium rod (JIS Class 2) having a diameter of 10 and a length of 35 mm or a diameter of 6 mm and a length of 100 mm was surface treated by the following steps.

(A) Surface cleaning step

This step (A) was carried out by the following operations:

(i) A shot blast operation with alumina particles (grade No. 220), (ii) A cleaning operation with trichloroethylene vapor at a temperature of 80° C., (iii) An alkali degreasing operation with an aqueous solution of 50 g/l of Alkali, Cleaner FC-315 which was a trademark of an weak alkali cleaning agent made by Nihon Parkerizing Co., at a temperature of 70° C. at an immersion time of 3 minutes, (iv) Washing with water, (v) Pickling with an aqueous solution containing 17% by weight of hydrochloric acid at room temperature for 30 seconds, and (vi) Washing with water

(B) First plating step

This first plating step was carried out by a flash plating treatment in a chemical substitution method with copper under the following conditions.

(i) Composition of plating liquid:

| Component | Amount |
|---|---|
| Copper sulfate | 10 g/l |
| Sodium hydroxide | 10 g/l |
| 37% formaldehyde aqueous solution | 20 ml/l |
| EDTA | 20 g/l |

(ii) Plating temperature: 45° C.

(iii) Thickness of the resultant plated copper layer: 0.7 μm (v) Washing with water

(C) Second plating step

This second plating step was carried out by an electroplating method with a nickel-phosphorus alloy under the following conditions.

(i) Composition of plating liquid:

| Component | Amount |
|---|---|
| Nickel sulfamate | 800 g/l |
| Nickel chloride | 15 g/l |
| Boric acid | 30 g/l |
| Sodium hypophosphite | 3 g/l |

(ii) Plating temperature: 57° C.

(iii) Current density: 20 A/dm$^2$ (iv) Thickness of resultant plated metal layer: 20 μm (v) Washing with water (vi) Hot air drying at about 80° C.

(D) Non-oxidative heat treating step

This step was carried out under a vacuum and under the following conditions:

(i) Vacuum pressure: 10−Torr (ii) Heat treating temperature: 600° C.

(iii) Heat treating time: 2 hours

(E) Surface activating step

This step was carried out under the following conditions:

(i) Composition of activating aqueous solution:

| Component | Amount |
|---|---|
| HF | 5% by weight |
| $HNO_3$ | 60% by weight |

(ii) Activating temperature: room temperature (iii) Activating time: 3 seconds immersion (iv) Washing with water.

(F) Coating step

In this step, a heat resistant and abrasion resistant coating layer comprising a nickel-phosphorus alloy matrix and SiC particles dispersed in the matrix was produced by an electroplating method under the following conditions:

(i) Composition of electroplating liquid:

| Component | Amount |
|---|---|
| Nickel sulfamate | 800 g/l |
| Nickel chloride | 15 g/l |
| Boric acid | 30 g/l |
| Sodium hypophosphite | 3 g/l |
| SiC | 200 g/l |

(ii) Plating temperature: 57° C.

(iii) Current density: 15 A/dm$^2$ (iv) Thickness of resultant plated metallic layer: 20 μm (v) Washing with water (vi) Hot air drying at about 80° C.

(G) Surface roughening step

In this step (G), the coated surface of the pin was roughened by a shot blast treatment with alumina particles (grid No. 200), and then cleaned up with trichloroethylene vapor. The roughened surface having a surface roughness ($R_Z$) of 5 to 7 μm was cleaned with trichloroethylene vapor.

(H) Solid lubricant coating step

A solid lubricating liquid (available under the trademark of FBT-116 (Defric Coat)) was sprayed to the roughened surface of the titanium rod to form a solid lubricant coating layer having a dry thickness of 10 μm.

The solid lubricant coating layer was cured at 180° C. for one hour.

The resultant surface treated titanium rod was subjected to the same abrasion test as mentioned in Example 1, with the following exceptions.

The lubricating oil was applied to the surface treated rod and thus the rod was tested in a dry condition.

The abrasion speed was 0.39 m/second.

The block load was increased stepwise by 50 kg every one minute.

Also, the surface treated titanium rod was subjected to the same folding test as mentioned in Example 6.

The test results are shown in Table 7.

EXAMPLE 13

The same procedures as in Example 12 were carried out, with the following exceptions.

The titanium rod was replaced by a titanium alloy rod consisting of a Ti-6Al-4V alloy and having the same dimensions as that in Example 12.

In the first flash plating step (B), the thickness of the resultant plated copper layer was changed to 0.2 μm.

In the second electroplating step (C), the current density was changed to 15 A/dm$^2$.

The non-oxidative heat treating step (D), the vacuum pressure was $10^{-2}$ Torr, the heat treating temperature was 450° C. and the heat treating time was 1.5 hours.

In the surface roughening step (G), alumina particles (grid No. 150) were used for the shot blast treatment and the resultant roughened surface had a surface roughness ($R_Z$) of 3 to 5 μm.

In the solid lubricant coating step (H), a solid lubricating liquid (available under the trademark of FH-70) containing a fluorine-containing polymer resin particles dispersed in an epoxy resin binder, was used.

The resultant solid lubricant coating layer was cured at a temperature of 180° C. for one hour and had a thickness of 25 μm.

The test results are shown in Table 7.

EXAMPLE 14

The same procedures as in Example 12 were carried out, with the following exceptions.

In the first flash plating step (B), the resultant plated copper layer had a thickness of 1.2 μm.

In the second electroplating step (C), the resultant plated nickel-phosphorus alloy layer had a thickness of 10 μm.

The non-oxidative heat treating step (D) was carried out under a vacuum pressure of $10^{-5}$ Torr at a temperature of 850° C. for one hour.

In the surface activating step (E), the activating (immersing) time was changed to 2 seconds.

In the coating step (F), the SiC in the plating liquid was replaced by BN in an amount of 200 g/l.

In the surface roughening step (G), alumina particles (grid No. 220) were used for the shot blast treatment, and the roughened surface had a surface roughness (Rz) of 6 to 8 μm.

In the solid lubricant coating step (H), a solid lubricating agent (available under the trademark of HMB-4A) containing $MoS_2$ particles dispersed in a polyamide resin binder, and the resultant solid lubricant coating layer had a thickness of 15 μm.

The test results are indicated in Table 7.

EXAMPLE 15

The same procedures as mentioned in Example 12 were carried out, with the following exceptions.

The first plating step (B) was carried out by a nickel flash plating treatment in the chemical substitution method under the following conditions:

(i) Composition of plating liquid:

| Component | Amount |
|---|---|
| Nickel chloride | 30 g/l |
| Sodium hypophosphite | 10 g/l |
| Sodium citrate | 10 g/l |

(ii) Plating temperature: 60° C.

(iii) Thickness of the resultant copper layer: 0.5 μm (iv) Washing with water

In the second electroplating step (C), the plating liquid further contained 200 g/l of WC, and the current density was changed to 15 A/dm$^2$.

The non-oxidative heat treating step (D) was carried out under a vacuum pressure of $10^{-2}$ Torr at a temperature of 550° C. for 3 hours.

In the surface activating step (E), the activating (immersing) time was changed to 5 seconds.

In the surface roughening step (G), alumina particles (grid No. 180) were used for the shot blast treatment and the resultant roughened surface had a surface roughness ($R_Z$) of 4 to 6 μm.

In the solid lubricant coating step (H), the thickness of the resultant coating layer was changed to 8 μm.

The test results are indicated in Table 7.

EXAMPLE 16

The same procedures as in Example 12 were carried out, with the following exceptions.

The titanium rod was replaced by the same titanium alloy (Ti-6Al-4V) rod as mentioned in Example 13.

In the first plating step (B), the same nickel flash plating procedure as mentioned in Example 15 was carried out except that the thickness of the resultant plated nickel layer was adjusted to 0.2 μm.

The non-oxidative heat treating step (D) was carried out under a vacuum pressure of $10^{-5}$ Torr at a temperature of 800° C. for one hour.

The surface activating step (E) was carried out in the same manner as in Example 15.

The coating step (H) was carried out in the same manner as in Example 14.

In the surface roughening step (G), alumina particles (grid No. 250) were used for the shot blast treatment and the resultant roughened surface had a surface roughness (Rz) of 7 to 9 μm.

The solid lubricant coating step (H) was carried out in the same manner as in Example 13, except that the resultant solid lubricant coating layer had a thickness of 10 μm.

The test results are shown in Table 7.

EXAMPLE 17

The same procedures as in Example 12 were carried out, with the following exceptions.

The titanium rod was replaced by the same titanium alloy (Ti-6Al-4V) rod as mentioned in Example 13.

The first plating step (B) was carried out in the same nickel flash plating method as mentioned in Example 15, except that the resultant flash plated nickel layer had a thickness of 1.5 μm.

In the second plating step (C), the plating layer further contained 200 g/l of BN, the current density was A/dm$^2$ and the resultant plated nickel-phosphorus alloy layer had a thickness of 10 μm.

The non-oxidative heat treating step (D) was carried out under a vacuum pressure of 10$^-$Torr at a temperature of 700° C. for 1.5 hours.

In the surface activating step (E), the activating (immersing) time was changed to 2 seconds.

In the coating step (F), the SiC in the plating liquid was replaced by 200 g/l of $Al_2O_3$ particles.

The solid lubricant coating step (H) was carried out in the same manner as mentioned in Example 14, except that the resultant solid lubricant coating layer had a thickness of 20 μm.

The test results are shown in Table 7.

COMPARATIVE EXAMPLE 5

The same procedures as in Example 1 were carried out, with the following exceptions.

The non-oxidative heat treating step (D) was carried out under a vacuum pressure of 10$^-$Torr at a temperature of 400° C. for 40 minutes.

In the surface roughening step (G), alumina particles (grid No. 220) were employed for the shot blast treatment and the roughened surface had a surface roughness ($R_Z$) of 6 to 8 μm.

The solid lubricant coating step (H) was carried out in the same manner as in Example 13 and the resultant solid lubricant coating layer had a thickness of 15 μm.

The test results are shown in Table 7.

COMPARATIVE EXAMPLE 6

The same procedures as mentioned in Example 12 were carried out, with the following exceptions.

The surface cleaning step (A) was carried out by applying a shot blast treatment with alumina particles (grid No. 220) to the titanium rod to roughen the surface into a surface roughness ($R_Z$) of 6 to 8 μm, and cleaning the roughened surface with trichloroethylene vapor.

The steps (B), (C), (D), (E), (F) and (G) were omitted.

The cleaned surface was coated with the same solid lubricant in the same manner as those mentioned in Example 12.

The test results are indicated in Table 7.

REFERENTIAL EXAMPLE 4

The same procedures as in Example 12 were carried out, with the following exceptions.

The first plating step (B) was carried out by the same strike plating method as mentioned in Example 1.

The non-oxidative heat treating step (D) was carried out under a vacuum pressure of $10^{-5}$ Torr at a temperature of 450° C. for 3 hours.

The test results are shown in Table 7.

REFERENTIAL EXAMPLE 5

The same procedures as mentioned in Example 12 were carried out, with the following exception.

The first plating step (B) was carried out in the same manner as mentioned in Example 1, except that the resultant plated copper layer had a thickness of 2 μm.

In the second plating step (C), the thickness of the resultant plated nickel-phosphorus alloy layer was 10 μm.

The non-oxidative heat treating step (D) was carried out under a vacuum pressure of $10^{-3}$ Torr at a temperature of 500° C. for 3 hours.

The test results are shown in Table 7.

TABLE 7

| Example No. | | Heat resistant $(*)_{12}$ | Abrasion resistant $(*)_{13}$ | Close adherence |
|---|---|---|---|---|
| Example | 12 | 2 | 2 | 4 |
| | 13 | 2 | 2 | 4 |
| | 14 | 2 | 2 | 4 |
| | 15 | 2 | 2 | 4 |
| | 16 | 2 | 2 | 4 |
| | 17 | 2 | 2 | 4 |
| Comparative | 5 | 2 | 2 | 2 |
| Example | 6 | 1 | 1 | 1 |
| Referential | 4 | 2 | 1 | 4 |
| Example | 5 | 2 | 2 | 3 |

Note:
$(*)_{12}$ . . . Class 2: The test piece exhibited a sufficiently high heat resistance until the temperature thereof reached 350° C.
Class 1: The heat resistance of the test piece was unsatisfactory at a temperature of 150° C. or more.
$(*)_{13}$ . . . Class 2: The test piece was seized under a block load of 715 to 780 kg.
Class 1: The test piece was seized under a block load of 65 kg.

EXAMPLE 18

A titanium rod (JIS Class 2) having a diameter of 10 mm and a length of 35 mm or a diameter of 6 mm and a length of 100 mm was surface treated by the following steps.

(A) Surface cleaning step

This step (A) was carried out by the following operations:

(i) A shot blast operation with alumina particles (grade No. 220), (ii) A cleaning operation with trichloroethylene vapor at a temperature of 80° C., (iii) An alkali degreasing operation with an aqueous solution of 50 g/l of Alkali Cleaner FC-315 which was a trademark of an weak alkali cleaning agent made by Nihon Parkerizing Co., at a temperature of 70° C. at an immersion time of 3 minutes, (iv) Washing with water, (v) Pickling with an aqueous solution containing 17% by weight of hydrochloric acid at room temperature for 30 seconds, and (vi) Washing with water

(B) First plating step

This first plating step was carried out by a strike plating method with copper under the following conditions.

(i) Composition of plating liquid:

| Component | Amount |
|---|---|
| Copper sulfate | 60 g/l |
| Rochelle salt | 160 g/l |

-continued

| Component | Amount |
|---|---|
| Sodium hydroxide | 50 g/l |

(ii) Plating temperature: room temperature
(iii) Current density: 0.5 A/dm$^2$
(iv) Thickness of the resultant first plated metal layer: 2 μm
(v) Washing with water (C) Second plating step This second plating step was carried out by an electroplating method with nickel-phosphorus alloy under the following conditions.
(i) Composition of plating liquid:

| Component | Amount |
|---|---|
| Nickel sulfamate | 800 g/l |
| Nickel chloride | 15 g/l |
| Boric acid | 30 g/l |
| Sodium hypophosphite | 3 g/l |

(ii) Plating temperature: 57° C.
(iii) Current density: 20 A/dm$^2$
(iv) Thickness of resultant plated metal layer: 20 μm
(v) Washing with water
(vi) Hot air drying at about 80° C.

(D) Non-oxidative heat treating step

This step was carried out in a nitrogen gas atmosphere under the following conditions:
(i) Heat treating temperature: 500° C.
(ii) Heat treating time: 3 hours (E) Surface activating step This step was carried out under the following conditions:
(i) Composition of activating aqueous solution:

| Component | Amount |
|---|---|
| HF | 5% by weight |
| $HNO_3$ | 60% by weight |

(ii) Activating temperature: room temperature
(iii) Activating time: 3 seconds immersion
(iv) Washing with water.

(F) Coating step

In this step, a heat resistant and abrasion resistant coating layer comprising a nickel-phosphorus alloy matrix and SiC particles dispersed in the matrix was produced by an electroplating method under the following conditions:
(i) Composition of electroplating liquid:

| Component | Amount |
|---|---|
| Nickel sulfamate | 800 g/l |
| Nickel chloride | 15 g/l |
| Boric acid | 30 g/l |
| Sodium hypophosphite | 3 g/l |
| SiC | 200 g/l |

(ii) Plating temperature: 57° C.
(iii) Current density: 15 A/dm$^2$
(iv) Thickness of resultant plated metallic layer: 20 μm
(v) Washing with water
(vi) Hot air drying at about 80° C.

The resultant surface treated titanium rod was subjected to the same bending test as mentioned in Example 6 except that the cross head falling distance was 6 mm, to the same dry abrasion test as mentioned in Example 1 in which the lubricating oil was applied to the test piece, and to the same wet abrasion test (II) as mentioned in Example 4, in which the lubricating oil was not applied to the test piece.

The test results are shown in Table 8.

EXAMPLE 19

The same procedures as those mentioned in Example 18 were carried out, with the following exceptions.

The titanium rod was replaced by the same titanium alloy (Ti-6Al-4V) rod as mentioned in Example 13.

The first plating step (B) was carried out by a strike plating method under the following conditions.
(i) Composition of plating liquid:

| Component | Amount |
|---|---|
| Nickel chloride | 100 g/l |
| Hydrochloric acid | 30 g/l |

(ii) Plating temperature: room temperature
(iii) Current density: 3 A/dm$^2$
(iv) Thickness of resultant plated nickel layer: 1.5 μm
(v) Washing with water.

The second plating step (C) was carried out under the following conditions.
(i) Composition of electroplating liquid:

| Component | Amount |
|---|---|
| Nickel sulfamate | 800 g/l |
| Nickel chloride | 15 g/l |
| Boric acid | 30 g/l |

(ii) Plating temperature: 57° C.
(iii) Current density: 15 A/dm$^2$
(iv) Thickness of resultant plated metallic layer: 10 μm
(v) Washing with water
(vi) Hot air drying at about 80° C.

The non-oxidative heat treating step (D) was carried out in an argon gas atmosphere at a temperature of 600° C. for 2 hours.

The coating step (F) was carried out under the following conditions.
(i) Composition of electroplating liquid:

| Component | Amount |
|---|---|
| Nickel sulfamate | 800 g/l |
| Nickel chloride | 15 g/l |
| Boric acid | 30 g/l |
| Sodium hypophosphite | 3 g/l |
| $Si_3N_4$ | 200 g/l |

(ii) Plating temperature: 57° C.
(iii) Current density: 15 A/dm$^2$
(iv) Thickness of resultant plated metallic layer: 10 μm
(v) Washing with water
(vi) Hot air drying at about 80° C.

The test results are shown in Table 8.

EXAMPLE 20

The same procedures as mentioned in Example 18 were carried out, with the following exceptions.

The first plating step (B) was carried out by a flash plating treatment in the chemical substitution method under the following conditions.

(i) Composition of plating liquid:

| Component | Amount |
|---|---|
| Copper sulfate | 10 g/l |
| Sodium hydroxide | 10 g/l |
| 37% formaldehyde aqueous solution | 20 ml/l |
| EDTA | 20 g/l |

(ii) Plating temperature: 45° C.

(iii) Thickness of resultant plated copper layer: 0.7 μm (iv) Washing with water The non-oxidative heat treating step (D) was carried out in a 8% hydrogen-nitrogen gas atmosphere at a temperature of 850° C. for one hour.

In the surface activating step (E), the activating (immersing) time was changed to 2 seconds.

In the coating step (F), the SiC in the plating liquid was replaced by 200 g/l of BN.

The test results are shown in Table 8.

EXAMPLE 21

The same procedures as mentioned in Example 18 were carried out, with the following exceptions.

The first plating step (B) was carried out by a flash plating method with nickel under the following conditions.

(i) Composition of plating liquid:

| Component | Amount |
|---|---|
| Nickel chloride | 30 g/l |
| Sodium hypophosphite | 10 g/l |
| Sodium citrate | 10 g/l |

(ii) Plating temperature: 60° C.

(iii) Thickness of the resultant plated nickel layer: 0.2 μm (iv) Washing with water The second plating step (C) was carried out in the same manner as mentioned in Example 19.

The non-oxidative heat treating step (D) was carried out in a nitrogen gas atmosphere at a temperature of 550° C. for 3 hours.

In the surface activating step (E), the activating immersing) time was changed to 5 seconds.

The coated titanium rod was further subjected to the following surface roughening step (G) and solid lubricant coating step (H).

(G) Surface roughening step

In this step (G), the coated surface of the rod was roughened by a shot blast treatment with alumina particles (grid No. 200), and then cleaned up with trichloroethylene vapor. The roughened surface had a surface roughness ($R_Z$) of 5 to 7 μm.

(H) Solid lubricant coating step

A solid lubricating liquid (available under the trademark of FBT-116 (Defric Coat)) containing $MoS_2$ particles dispersed in a phenol-formaldehyde resin binder was sprayed to the roughened surface of the rod to form a solid lubricant coating layer having a dry thickness of 10 μm.

The solid lubricant coating layer was cured at 180° C. for one hour.

The test results are shown in Table 8.

EXAMPLE 22

The same procedures as mentioned in Example 18 were carried out, with the following exceptions.

The titanium rod was replaced by the same titanium alloy rod (Ti-6Al-4V alloy) as mentioned in Example 13.

The first plating step (B) was carried out by the same copper flash plating method as mentioned in Example 20, except that the thickness of the resultant plated copper layer was adjusted to 1.2 μm.

In the second plating step (C), the thickness of the resultant plated nickel-phosphorus alloy layer was controlled to 15 μm.

The oxidative heat treating step (D) was carried out in an argon gas atmosphere at a temperature of 450° C. for 1.5 hours.

The surface activating step (E) was carried out in the same manner as mentioned in Example 21.

In the coating step (F), the SiC in the plating liquid was replaced by 200 g/l of WC, and the thickness of the resultant heat resistant and abrasion resistant coating layer was adjusted to 40 μm.

The coated rod was further subjected to the same surface roughening step (G) and solid lubricant coating step (H) as mentioned in Example 21, with the following exceptions.

In the surface roughening step (G), alumina particles (grid No. 250) were employed for the shot blast treatment and the resultant roughened surface had a surface roughness of 7 to 9 μm.

In the solid lubricant coating step (H), the FBT-116 was replaced by a solid lubricant liquid FH-70 (trademark) available from KAWAMURA KENKYUSHO, and containing fluorine-containing polymer resin particles dispersed in an epoxy resin binder. The thickness of the solid lubricant coating layer was 15 μm.

The test results are indicated in Table 8.

EXAMPLE 23

The same procedures as mentioned in Example 18 were carried out, with the following exceptions.

The titanium rod was replaced by the same titanium alloy rod (Ti-6Al-4V alloy) as mentioned in Example 13.

In the first plating step (B), the resultant strike plated copper layer had a thickness of 3 μm.

The second plating step (C) was carried out in the same manner as mentioned in Example 19, except that the thickness of the plated nickel layer was controlled to 25 μm.

The non-oxidative heat treating step (D) was carried out in an 8% hydrogen-nitrogen mixed gas atmosphere at a temperature of 700° C. for 1.5 hours.

In the surface activating step (E), the activating (immersing) time was changed to 2 seconds.

In the coating step (F), the SiC in the plating liquid was replaced by 200 g/l of $Al_2O_3$, and the thickness of the resultant heat resistant and abrasion resistant coating layer was 25 μm.

The coated rod was subjected to the same surface roughening step (G) and solid lubricant coating step (H) as mentioned in Example 21.

In the surface roughening step (G), alumina particles (grid No. 150) were employed for the shot blast treatment, and the roughened surface had a surface roughness ($R_Z$) of 3 to 5 μm.

In the solid lubricant coating step (H), a solid lubricating liquid available under the trademark of HMB-4A and containing $MoS_2$ particles dispersed in a polyamide resin binder, was employed in place of the FBT-116. The resultant solid lubricant coating layer had a thickness of 25 μm.

The test results are indicated in Table 8.

Comparative Example 7

The same procedures as mentioned in Example 18 were carried out, with the following exceptions.

The non-oxidative heat treating step (D) was carried out in a nitrogen gas atmosphere at a temperature of 400° C. for 40 minutes.

The test results are shown in Table 8.

COMPARATIVE EXAMPLE 8

The same procedures as in Example 18 were carried out with the following exceptions.

The first plating step (B) was carried out by the same copper flash plating method as mentioned in Example 20.

The non-oxidative heat treating step (D) was carried out in an 8% hydrogen-nitrogen mixed gas atmosphere at a temperature of 350° C. for 3 hours.

In the surface activating step (E), the activating (immersing) time was changed to 2 seconds.

The coating step (F) was carried out in the same manner as mentioned in Example 20 to form a heat resistant and abrasion resistant coating layer consisting of a nickel-phosphorus alloy matrix and BN particles dispersed in the matrix.

The coated rod was subjected to the same surface roughening step (G) and solid lubricant coating step (H) as mentioned in Example 21.

The test results are shown in Table 8.

COMPARATIVE EXAMPLE 9

The same procedures as those mentioned in Example 18 were carried out with the following exceptions.

In the first plating step (B), the resultant strike plated copper layer had a thickness of 1 μm.

The second plating step (C) was omitted and the first plated titanium rod was further plated in the same non-electrolytic nickel-phosphorus alloy plating method as mentioned in Comparative Example 4 by using the NYCO ME BLATING BATH (trademark). The plated metallic layer had a thickness of 20 μm.

The non-oxidative heat treating step (D) was replaced by an oxidative heat treating step in an oxidative atmosphere at a temperature of 450° C. for 20 hours in a Muffle furnace, and the heat treated product was immersed in an aqueous solution of about 33% by weight of nitric acid at room temperature for 15 minutes to eliminate the oxidized portion of the product, and then washed with water.

The surface activating step (E) was omitted and the coating step (F) was replaced by a chromium electroplating step under the following conditions.

(i) Composition of plating liquid

| Component | Amount |
|---|---|
| $CrO_3$ | 265 g/l |
| $H_2SO_4$ | 1% based on the weight of $CrO_3$ |

(ii) Plating temperature: 45° C.
(iii) Current density: 40 A/dm$^2$
(iv) Thickness of the plated Cr layer: 20 μm
(v) Washing with water
(vi) Hot air drying at about 80° C.

The test results are indicated in Table 8.

TABLE 8

| Example No. | | Heat & abrasion resistant $(*)_{14}$ | Heat and abrasion resistive sliding property $(*)_{15}$ | Close adherence $(*)_{16}$ |
|---|---|---|---|---|
| Example | 18 | 3 | 1 | 3 |
| | 19 | 3 | 1 | 3 |
| | 20 | 3 | 1 | 3 |
| | 21 | — | 3 | 3 |
| | 22 | — | 3 | 3 |
| | 23 | — | 3 | 3 |
| Comparative Example | 7 | 2 | 1 | 2 |
| | 8 | — | 2 | 1 |
| | 9 | 1 | 1 | 1 |

Note:
$(*)_{14}$ . . . Class 3: The test piece was seized under a block load of 780 to 840 kg.
Class 2: The test piece was seized under a block load of about 580 kg.
Class 1: The test piece was seized under a block load of 200 kg.
$(*)_{15}$ . . . Class 3: The test piece was seized at a block load of 715 to 780 kg.
Class 2: The test piece was seized at a block load of about 430 kg.
Class 1: The test piece was seized at a block load of about 65 kg.
$(*)_{16}$ . . . Class 3: Until the bend deformation of the test piece reached 6 mm, the composite coating layer of the test piece was not broken and separated.
Class 2: Until the bend deformation of the test piece reached 6 mm, a portion or the composite coating layer was separated.
Class 1: Until the bend deformation of the test piece reached 6 mm, most of the composite coating layer was separated.

Table 8 clearly indicates that the composite coating layers of Examples 18 to 23 produced in accordance with the process of the present invention exhibited an excellent close adherence to the titanium containing metallic materials and higher heat and abrasion resistances than those of the conventional chromium layer.

We claim:

1. A process for surface treating a titanium-containing metallic material, comprising the steps of:

(A) cleaning a surface of a titanium-containing metallic material;

(B) first plating the resultant cleaned surface of the titanium-containing metallic material with a member selected from the group consisting of copper and nickel to a thickness of 1 to 6 μm by a strike plating method or to a thickness of 0.1 to 5 μm by a flash plating method;

(C) second plating the resultant first surface of the titanium-containing metallic material with a member selected from the group consisting of nickel, nickel-phosphorus alloys and composite materials comprising a matrix consisting of a nickel-phosphorous alloy and a number of fine ceramic particles dispersed in the matrix, to a thickness of 5 to 30 μm by an electro-plating method;

(D) non-oxidatively heat-treating the resultant second plated titanium-containing metallic material at a temperature of 450° C. or more for one hour or more;

(E) surface-activating the resultant surface of the non-oxidatively heat-treated titanium-containing metallic material; and (F) coating the resultant surface-activated surface of the titanium-containing metallic material with a heat-resistant and abrasion-resistant coating layer comprising a matrix comprising a member selected from the group consisting of nickel-phosphorus alloys and cobalt and a number of fine ceramic particles dispersed in the matrix to a thickness of 5 to 500 μm by an electroplating method.

2. The surface treating process as claimed in claim 1, wherein the fine ceramic particles employed in the second plating step comprise at least one member selected from the group consisting of SiC, $Si_3N_4$, BN, $Al_2O_3$, WC, $ZrO_2$, diamond and CrB.

3. The surface treating process as claimed in claim 1, wherein the non-oxidative heat treating step is carried out under a vacuum pressure of from $10^{-1}$ to $10^{-5}$ Torr.

4. The surface treating process as claimed in claim 1, wherein the non-oxidative heat treating step is carried out in an inert or reductive gas atmosphere comprising at least one member selected from the group consisting of nitrogen, argon and hydrogen.

5. The surface treating process as claimed in claim 1, wherein the surface-activating step is carried out by bringing the surface of the non-oxidatively heat treated titanium-containing metallic material into contact with a surface-activating aqueous solution containing 3 to 10% by weight of hydrofluoric acid and 50 to 70% by weight of nitric acid.

6. The surface treating process as claimed in claim 1, wherein the fine ceramic particles in the heat-resistant and abrasion-resistant coating layer comprise at least one member selected from the group consisting of SiC, $Si_3N_4$, BN, $Al_2O_3$, WC, $ZrB_2$, diamond and CrB.

7. The surface treating process as claimed in claim 1, wherein the fine ceramic particles have an average particle size of from 0.1 to 10.0 μm.

8. The surface treating process as claimed in claim 1, wherein the heat-resistant and abrasion-resistant coating layer has a thickness of 5 to 500 μm.

9. The surface treating process as claimed in claim 1, which further comprises the steps of:

(G) surface-roughening the resultant surface of the heat-resistant and abrasion-resistant coating layer of the coated titanium-containing metallic material, and (H) coating the resultant roughened surface of the coated titanium-containing metallic material with a solid lubricant coating layer comprising at least one member selected from the group consisting of $MoS_2$, graphite, boron nitride and fluorine-containing polymer resins.

10. The surface treating process as claimed in claim 1, wherein the titanium containing metallic material comprises one of titanium and titanium alloy.

11. The surface treating process as claimed in claim 4, wherein, int he inert or reductive gas atmosphere, the content of oxygen is restricted to a level not exceeding 1% by volume.

12. The surface treating process as claimed in claim 9, wherein the resultant surface roughened surface of the coated titanium-containing metallic material has a surface roughness ($R_Z$) of 1.0 to 10.0 μm determined in accordance with JIS B0601.

13. The surface treating process as claimed in claim 9, wherein the surface-roughening step is carried out by applying a sandblast treatment with alumina particles with a grid number of 120 to 270, to the surface of the heat resistant and abrasion resistant coating layer of the coated titanium-containing metallic material.

14. The surface treating process as claimed in claim 9, wherein the resultant solid lubricant coating layer has a thickness of 5 to 30 μm.

15. The surface treating process as claimed in claim 9, wherein the solid lubricant coating layer is cured at a temperature of from 150° C. to 250° C.

* * * * *